US009223261B2

(12) United States Patent
Tamura et al.

(10) Patent No.: US 9,223,261 B2
(45) Date of Patent: Dec. 29, 2015

(54) IMAGE FORMING APPARATUS WITH FIXING UNIT ADAPTED TO FIX TONER INCLUDING PRESSURE-INDUCED PHASE TRANSITION TONER

(75) Inventors: Hirohmi Tamura, Kanagawa (JP); Satoru Ishikake, Kanagawa (JP); Hirokatsu Suzuki, Kanagawa (JP); Ryuji Yoshida, Kanagawa (JP); Takashi Bisaiji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 285 days.

(21) Appl. No.: 13/538,281

(22) Filed: Jun. 29, 2012

(65) Prior Publication Data

US 2013/0011171 A1 Jan. 10, 2013

(30) Foreign Application Priority Data

Jul. 4, 2011 (JP) ..... 2011-148206

(51) Int. Cl.
*G03G 21/00* (2006.01)
*G03G 15/20* (2006.01)

(52) U.S. Cl.
CPC .... *G03G 15/2021* (2013.01); *G03G 2215/0129* (2013.01); *G03G 2215/0141* (2013.01); *G03G 2215/1661* (2013.01); *G03G 2221/0005* (2013.01)

(58) Field of Classification Search
USPC ..... 399/321, 328
See application file for complete search history.

(56) References Cited

U.S. PATENT DOCUMENTS

| | | | |
|---|---|---|---|
| 4,678,318 | A | 7/1987 | Bisaiji |
| 4,837,597 | A | 6/1989 | Bisaiji |
| 4,875,079 | A | 10/1989 | Bisaiji et al. |
| 5,107,302 | A | 4/1992 | Bisaiji |
| 5,227,842 | A | 7/1993 | Hayashi et al. |
| 5,258,248 | A | 11/1993 | Tokuhashi et al. |

(Continued)

FOREIGN PATENT DOCUMENTS

| | | | |
|---|---|---|---|
| JP | S55-15186 | A | 2/1980 |
| JP | 58086557 | A | 5/1983 |

(Continued)

OTHER PUBLICATIONS

Ogata, N., Kagakudoujin "Polycondensation" 1971.

(Continued)

*Primary Examiner* — Quana M Grainger
(74) *Attorney, Agent, or Firm* — Harness, Dickey & Pierce, P.L.C.

(57) ABSTRACT

An image forming apparatus including multiple imaging units and a fixing unit is provided. Each of the imaging units includes an image bearing member, a developing device containing a toner including a pressure-induced phase transition resin or a thermoplastic resin, a transfer device, and an image bearing member cleaner, and is adapted to form a toner image with the toner. The fixing unit includes a pressure fixing device adapted to fix the toner including the pressure-induced phase transition resin on the recording medium by applying a temperature Tb and a pressure Pb thereto in a pressure fixing nip, and a heat fixing device adapted to fix the toner including the thermoplastic resin on the recording medium by applying a temperature Ta and a pressure Pa thereto in a heat fixing nip. The image forming apparatus satisfies the following inequations: Tb<Ta and Pb>Pa.

9 Claims, 14 Drawing Sheets

(56) References Cited

U.S. PATENT DOCUMENTS

| | | | | |
|---|---|---|---|---|
| 5,270,783 | A | 12/1993 | Bisaiji et al. | |
| 5,278,613 | A | 1/1994 | Bisaiji et al. | |
| 5,371,579 | A | 12/1994 | Bisaiji | |
| 5,402,220 | A | 3/1995 | Tanaka et al. | |
| 5,410,339 | A | 4/1995 | Bisaiji et al. | |
| 5,471,282 | A | 11/1995 | Hayashi et al. | |
| 5,701,566 | A | 12/1997 | Bisaiji et al. | |
| 5,729,808 | A | 3/1998 | Bisaiji | |
| 5,761,594 | A | 6/1998 | Seto et al. | |
| 5,887,218 | A | 3/1999 | Yuu et al. | |
| 5,913,092 | A | 6/1999 | Bisaiji et al. | |
| 5,926,678 | A | 7/1999 | Bisaiji | |
| 5,937,228 | A | 8/1999 | Shoji et al. | |
| 5,970,280 | A | 10/1999 | Suzuki et al. | |
| 5,987,290 | A | 11/1999 | Bisaiji | |
| 6,061,543 | A | 5/2000 | Kayahara et al. | |
| 6,091,922 | A | 7/2000 | Bisaiji | |
| 6,259,879 | B1 | 7/2001 | Bisaiji | |
| 6,366,751 | B1 | 4/2002 | Shakuto et al. | |
| 6,434,354 | B2 | 8/2002 | Bisaiji | |
| RE38,206 | E | 7/2003 | Bisaiji et al. | |
| 6,625,409 | B2 | 9/2003 | Shakuto et al. | |
| 6,654,579 | B2 | 11/2003 | Shakuto et al. | |
| 6,757,509 | B2 | 6/2004 | Shoji et al. | |
| 6,978,109 | B2 | 12/2005 | Shoji et al. | |
| 7,212,753 | B2 | 5/2007 | Suzuki et al. | |
| 7,269,384 | B2 | 9/2007 | Someya et al. | |
| 7,330,688 | B2 * | 2/2008 | Watanabe et al. | 399/329 |
| 7,526,242 | B2 | 4/2009 | Takagaki et al. | |
| 7,551,882 | B2 | 6/2009 | Seto et al. | |
| 7,577,387 | B2 | 8/2009 | Suzuki | |
| 7,593,671 | B2 | 9/2009 | Ishikawa et al. | |
| 7,620,336 | B2 | 11/2009 | Yura et al. | |
| 7,627,260 | B2 | 12/2009 | Shiraishi et al. | |
| 7,643,767 | B2 | 1/2010 | Seto et al. | |
| 7,711,300 | B2 | 5/2010 | Nakafuji et al. | |
| 7,711,301 | B2 | 5/2010 | Takemoto et al. | |
| 7,790,343 | B2 | 9/2010 | Suzuki et al. | |
| 7,796,920 | B2 | 9/2010 | Taguma et al. | |
| 7,835,671 | B2 | 11/2010 | Suzuki | |
| 7,884,840 | B2 | 2/2011 | Sohmiya et al. | |
| 7,907,881 | B2 | 3/2011 | Kayahara et al. | |
| 7,909,081 | B2 | 3/2011 | Sudo et al. | |
| 7,912,412 | B2 | 3/2011 | Fujita et al. | |
| 7,941,075 | B2 | 5/2011 | Shiraishi et al. | |
| 7,997,320 | B2 | 8/2011 | Yamamoto et al. | |
| 8,010,005 | B2 | 8/2011 | Sukesako et al. | |
| 8,095,042 | B2 | 1/2012 | Tamura | |
| 8,099,025 | B2 | 1/2012 | Ishikake | |
| 8,126,346 | B2 | 2/2012 | Yura et al. | |
| 2001/0007616 | A1 | 7/2001 | Bisaiji | |
| 2002/0081128 | A1 | 6/2002 | Shakuto et al. | |
| 2002/0090229 | A1 | 7/2002 | Shakuto et al. | |
| 2002/0122675 | A1 | 9/2002 | Shoji et al. | |
| 2003/0049050 | A1 | 3/2003 | Shakuto et al. | |
| 2003/0063923 | A1 | 4/2003 | Yasutomi et al. | |
| 2005/0152707 | A1 | 7/2005 | Suzuki et al. | |
| 2005/0254846 | A1 | 11/2005 | Yura et al. | |
| 2006/0008302 | A1 | 1/2006 | Someya et al. | |
| 2007/0014596 | A1 | 1/2007 | Sohmiya et al. | |
| 2007/0025776 | A1 | 2/2007 | Suzuki | |
| 2007/0065188 | A1 | 3/2007 | Takagaki et al. | |
| 2007/0122202 | A1 | 5/2007 | Taguma et al. | |
| 2007/0127951 | A1 | 6/2007 | Ishikawa et al. | |
| 2007/0212126 | A1 | 9/2007 | Seto et al. | |
| 2007/0212129 | A1 | 9/2007 | Takemoto et al. | |
| 2007/0218386 | A1 | 9/2007 | Suzuki et al. | |
| 2007/0274741 | A1 | 11/2007 | Shiraishi et al. | |
| 2008/0008505 | A1 | 1/2008 | Seto et al. | |
| 2008/0069610 | A1 | 3/2008 | Nakafuji et al. | |
| 2008/0085137 | A1 | 4/2008 | Suzuki | |
| 2008/0124106 | A1 | 5/2008 | Enoki et al. | |
| 2008/0185091 | A1 | 8/2008 | Sudo et al. | |
| 2008/0196832 | A1 | 8/2008 | Nakamura et al. | |
| 2008/0199229 | A1 | 8/2008 | Fujita et al. | |
| 2008/0219717 | A1 | 9/2008 | Kayahara et al. | |
| 2008/0219718 | A1 | 9/2008 | Fujita et al. | |
| 2008/0223515 | A1 | 9/2008 | Sudo et al. | |
| 2008/0225351 | A1 | 9/2008 | Sudo et al. | |
| 2008/0227019 | A1 | 9/2008 | Iwasaki et al. | |
| 2008/0304879 | A1 | 12/2008 | Tamura | |
| 2009/0000445 | A1 | 1/2009 | Yamamoto et al. | |
| 2009/0044915 | A1 | 2/2009 | Mizutani et al. | |
| 2009/0067869 | A1 * | 3/2009 | Toyonori et al. | 399/69 |
| 2009/0196638 | A1 | 8/2009 | Sukesako et al. | |
| 2009/0245896 | A1 | 10/2009 | Ishikake et al. | |
| 2009/0257782 | A1 | 10/2009 | Ishikake | |
| 2009/0311006 | A1 | 12/2009 | Shiraishi et al. | |
| 2010/0021195 | A1 | 1/2010 | Yura et al. | |
| 2010/0040393 | A1 | 2/2010 | Kawahara et al. | |
| 2010/0278558 | A1 | 11/2010 | Enoki et al. | |
| 2010/0315680 | A1 | 12/2010 | Ishikake | |
| 2011/0013950 | A1 | 1/2011 | Furuya et al. | |
| 2011/0058832 | A1 | 3/2011 | Suzuki et al. | |
| 2011/0064475 | A1 | 3/2011 | Yoshida et al. | |
| 2011/0064488 | A1 | 3/2011 | Takahashi et al. | |
| 2011/0064489 | A1 | 3/2011 | Bisaiji et al. | |
| 2011/0110694 | A1 | 5/2011 | Ishikake | |
| 2011/0164895 | A1 | 7/2011 | Ishikake et al. | |
| 2011/0183247 | A1 * | 7/2011 | Kadokura et al. | 430/105 |
| 2011/0223527 | A1 | 9/2011 | Iio et al. | |
| 2011/0229179 | A1 | 9/2011 | Yoshida et al. | |
| 2012/0020706 | A1 | 1/2012 | Yoshida et al. | |
| 2012/0045262 | A1 | 2/2012 | Yoshida et al. | |

FOREIGN PATENT DOCUMENTS

| | | | |
|---|---|---|---|
| JP | 58126561 | A | 7/1983 |
| JP | 59119364 | A | 7/1984 |
| JP | 07044034 | A | 2/1995 |
| JP | 2007128109 | A | 5/2007 |
| JP | 2009053318 | A | 3/2009 |
| JP | 2009244857 | A | 10/2009 |
| JP | 2009251021 | A | 10/2009 |
| JP | 2010049065 | A | 3/2010 |
| JP | 2010191197 | A | 9/2010 |

OTHER PUBLICATIONS

Takiyama, E., "Polyester Resin Handbook" The Nikkan Kogyo Shimbun, Ltd. (1998).

Doi, Y. et al., "Biopolymers, Polyester II—Properties and Chemical Synthesis" Wiley-VCH (2002).

Ruzette, A.-V.G. et al. "A Simple Model for Baroplastic Behavior in Block Copolymer Melts" Journal of Chemical Physics, 114, 8205-8209 (2001).

Gonzalez-Leon, J.A. et al., "Low-temperature Processing of 'Baroplastics' by Pressure-induced Flow" Nature, 426, 424-428 (2003).

Pollard, M. et al., "The Effect of Hydrostatic Pressure on the Lower Critical Ordering Transition in Diblock Copolymers" Macromolecules, 31, 6493-6498 (1998).

Office Action for corresponding Japanese application No. 2011-148206 dated Mar. 27, 2015.

* cited by examiner

IMAGE FORMING APPARATUS WITH FIXING UNIT ADAPTED TO FIX TONER INCLUDING PRESSURE-INDUCED PHASE TRANSITION TONER

CROSS-REFERENCE TO RELATED APPLICATIONS

This patent application is based on and claims priority pursuant to 35 U.S.C. §119 to Japanese Patent Application No. 2011-148206, filed on Jul. 4, 2012, in the Japanese Patent Office, the entire disclosure of which is hereby incorporated herein by reference.

BACKGROUND

1. Technical Field

The present disclosure relates to an image forming apparatus with a fixing unit.

2. Description of Related Art

Energy-saving image forming apparatuses are demanded in accordance with recent increasing momentum toward conservation of the global environment. On the other hand, full-color image forming apparatuses are also demanded producing both black-and-white and full-color images in accordance with recent colorization of office documents.

Electrophotographic image forming apparatuses, including at least one of a function of copier, printer, facsimile, and plotter, equipped with a fixing device are well known. Various types of fixing devices have been proposed which suppress defective fixing of a toner image on a recording medium. For example, a fixing device including a fixing roller and a pressing roller is well known. The fixing roller is comprised of a heat roller to be heated by a heat source. The pressing roller and the fixing roller press against each other to form a fixing nip therebetween in which a toner image is fixed on a recording medium. Such a fixing process is a so-called heat roller process.

A fixing device employing the heat roller process generally includes a fixing roller and a pressing roller. The fixing roller is adapted to melt a toner including a thermoplastic resin (hereinafter "thermoplastic resin toner") on a recording medium. The pressing roller presses against the fixing roller so that the recording medium can be sandwiched therebetween. The fixing roller is a cylindrical member containing a heating element on the central axis thereof. The heating element may be, for example, a halogen lamp which generates heat upon application of a predetermined voltage. Because the heating element is disposed on the central axis of the fixing roller, heat generated by the heating element is uniformly radiated by the inner wall of the fixing roller. Therefore, the temperature distribution of the outer wall of the fixing roller is uniform in a circumferential direction. The outer wall of the fixing roller is heated to a proper temperature for fixing toner images, for example, 130 to 200° C. The fixing and pressing rollers rotate in the opposite direction while being heated and pressed against each other so that the recording medium having the thermoplastic resin toner thereon is sandwiched therebetween. In the fixing nip where the fixing roller and the pressing roller meet and press against each other, the thermoplastic resin toner is melted by heat from the fixing roller and fixed on the recording medium.

The heat roller process has a disadvantage that a large amount of energy is wasted. The heat roller process has another disadvantage that it takes a relatively long time to heat the fixing roller to a predetermined fixing temperature since the image forming apparatus is powered on. In a case in which the image forming apparatus has a high linear speed (hereinafter "high-speed machine"), the following problems further arise. It is difficult to secure sufficient time for fixing the thermoplastic resin toner on a recording medium in the heat roller process in which heat and pressure are simultaneously applied to the toner. Therefore, in high-speed machines, the fixing roller is required to provide a higher temperature and a higher pressure, which results in a large power consumption. Also, the fixing roller is required to have a larger diameter so as to secure sufficient time for fixing the thermoplastic resin toner on a recording medium, which results in a larger heat capacity and a larger power consumption in the fixing roller. In this case, because non-image areas are unnecessarily heated, the recording medium undesirably curls up by the unnecessary heat.

In view of these situations, an attempt to reduce the fixing temperature in the fixing nip and another attempt to fix a toner image on a recording medium without heat have been made. For example, Japanese Patent Application Publication No. 58-126561 describes a pressure fixing process in which a toner image is fixed on a recording medium by pressure without heat energy. Japanese Patent Application Publication No. 58-086557 describes a pressurization toner including 30 to 70 parts by weight of a bis(fatty acid amide) and 30 to 70 parts by weight of a polyethylene wax as binding agents.

Japanese Patent Application Publication No. 2009-251021 describes a pressure fixing process in which a toner image on a recording medium is preliminarily heated and softened before being fixed thereon by pressure, to improve fixing strength and image gloss.

Japanese Patent Application Publication No. 59-119364 describes a process in which a toner is dissolved in a solvent which can dissolve silicone oils. The toner is fixed on a recording medium without heat. Japanese Patent No. 3290513 describes a wet fixing process using a fixing liquid. The fixing liquid is an O/W emulsion in which a solvent which is insoluble or poorly soluble in water is dispersed in water. The fixing liquid can dissolve or swell toner. The fixing liquid is sprayed or dropped on the surface of a recording medium so that an unfixed toner image is dissolved or swelled thereon. The toner image is fixed on the recording medium by drying the recording medium.

Image forming apparatuses using a toner including a resin in which phase transition is induced by pressure (hereinafter "pressure-induced phase transition resin toner") have been also proposed. The pressure-induced phase transition resin is generally fluidized under pressure and is also called as baroplastics. For example, ethylene-based unsaturated compounds prepared by mini emulsion processes or living radial polymerizations and polyester block copolymers including amorphous blocks and crystalline blocks are well known as the pressure-induced phase transition resins.

Japanese Patent No. 4582227 describes an image forming method in which a pressure-induced phase transition resin toner including a polyester block copolymer is fixed at a fixing temperature of 15 to 50° C. and a fixing pressure of 0.1 to 5.0 MPa. Japanese Patent No. 4525828 describes an image forming apparatus in which a pressure-induced phase transition resin toner is fixed with a maximum fixing pressure of 5.0 MPa without heat. Japanese Patent Application Publication No. 2009-053318 describes an image forming apparatus in which a pressure-induced phase transition resin toner remaining on an image bearing member (photoreceptor) is removed by a cleaning blade. Japanese Patent Application Publication No. 2010-191197 describes a full-color image forming apparatus including multiple imaging units containing different-color pressure-induced phase transition resin toners. In this full-color image forming apparatus, a full-color toner image formed on an intermediate transfer belt is simultaneously transferred onto and fixed on a recording medium. Generally, pressure-induced phase transition resin toners have an advantage over thermoplastic resin toners in terms of energy saving.

However, a full-color image forming apparatus including multiple imaging units containing different-color pressure-induced phase transition resin toners has the following problem.

In such a full-color image forming apparatus including multiple imaging units containing different-color pressure-induced phase transition resin toners, multiple toner images are transferred onto an intermediate transfer medium or a recording medium directly. Thereafter, the toner images are fixed on the recording medium upon application of a high pressure thereto. The high pressure can be applied to the toner images with a pair of metallic rollers. The toner images are applied with a uniform pressure to be uniformly fixed on the recording medium.

In a full-color toner image in which multiple toner images are superimposed on one another, the toner pile height varies with location. Due to the non-uniform toner pile height, the full-color toner image is applied with a non-uniform pressure in the fixing nip and fixed on a recording medium with non-uniform fixing strength. FIG. 1 is a schematic view illustrating a related-art process of fixing a full-color toner image on a recording medium. A full-color toner image includes an image area having a high toner pile height formed with multiple color toners and an adjacent image area having a low toner pile height formed with a single color toner. In image forming apparatuses using thermoplastic resin toners, the fixing member, such as a fixing roller or a fixing belt, generally has an elastic layer. The elastic layer can intimately contact the surface of the toner image following its non-uniform toner pile height. Thus, the toner image can be uniformly applied with heat and pressure.

By contrast, in image forming apparatuses using pressure-induced phase transition resin toners, the fixing members, i.e., the metallic rollers, generally do not have an elastic layer. Therefore, the fixing members cannot intimately contact the surface of the toner image following its non-uniform toner pile height. As a result, the image area having a low toner pile height is applied with only a small pressure and the pressure-induced phase transition resin toner cannot be sufficiently fluidized, as shown in FIG. 1. The pressure-induced phase transition resin toner cannot sufficiently anchor in the recording medium. Even in a case in which the pressure-induced phase transition resin toners are first formed into a film on an intermediate transfer medium by pressure before being fixed on a recording medium by pressure, the resulting film is non-uniform for the same reason described above. Some toner particles may remain in their original form without being formed into the film. In this case, remaining toner particles may contaminate the user's hands or clothes or degrade color reproducibility. To solve this problem, a higher pressure is required in the process of forming the film or fixing the film on the recording medium, which results in undesirable increase in the size and weight of the image forming apparatus.

When toner particles are applied with a non-uniform pressure, the toner particles cannot sufficiently fluidize to aggregate. Thus, the resulting image has either toner grain aggregate or voids. When the resulting image is a single-color image, the image density is low. When the resulting image is a full-color image, the fixing strength between the toner particles and the recording medium is weak and color reproducibility is poor. Because the resulting image has either toner grain aggregate or void, the surface thereof is not smooth and the image exhibits poor gloss.

When removing toner particles remaining on an image bearing member, such as a photoreceptor or an intermediate transfer medium, a cleaning blade, comprised of a urethane rubber, etc., is brought into contact with the image bearing member while applying a predetermined stress to a nip formed between the image bearing member and the cleaning blade. In a case in which pressure-induced phase transition resin toner particles are removed with the cleaning blade, the pressure-induced phase transition resin toner particles may fluidize upon application of the stress and contaminate the image bearing member. Because the fluidized pressure-induced phase transition resin toner particles may alter their shapes or form large aggregates, it may be difficult to feed them to a waste toner tank. Thus, the pressure-induced phase transition resin toner is preferably removed without application of mechanical stress.

In a tandem full-color image forming apparatus, in which multiple imaging units are arranged in tandem, toner particles transferred onto an intermediate transfer medium or recording medium may be retransferred on image bearing members (i.e., photoreceptors) on downstream sides. Imaging units on upstream sides consume much more toner particles so that the resulting image is formed with a desired amount of toner particles. Thus, not all the toner particles can be transferred onto a recording medium and remaining on the photoreceptors. Each photoreceptor cleaner in each imaging unit in the tandem full-color image forming apparatus receives much more toner particles than that in a single imaging unit in a black-and-white image forming apparatus. The photoreceptor cleaner in the most downstream imaging unit in the tandem full-color image forming apparatus receives a quite large amount of toner particles which cannot be sufficiently removed with a cleaning brush.

The above-described problems can be solved if an image area having a high toner pile height is pre-fixed on a recording medium, as illustrated in FIG. 2, so that the toner image has a uniform surface and is prevented from being applied with a non-uniform pressure in the main fixing process. For example, in a related art image forming apparatus illustrated in FIG. 3, a pressure-induced phase transition resin toner image of each color is directly transferred onto a recording medium P and immediately thereafter is applied with a pressure in each pressure fixing nip in each pressure fixing device 40. Thus, the toner pile height can be effectively reduced. However, the image forming apparatus illustrated in FIG. 3 is disadvantageous in size, weight, and manufacturing cost.

SUMMARY

In accordance with some embodiments, an image forming apparatus is provided. The image forming apparatus includes multiple imaging units and a fixing unit. Each of the imaging units includes an image bearing member, a developing device containing a toner, a transfer device, and an image bearing member cleaner. The developing device is adapted to develop an electrostatic latent image formed on the image bearing member into a toner image with the toner. The toner includes a pressure-induced phase transition resin or a thermoplastic resin. The transfer device is adapted to transfer the toner image from the image bearing member onto an intermediate transfer medium or a recording medium. The image bearing member cleaner is adapted to remove residual toner particles remaining on the image bearing member without being transferred. The fixing unit is adapted to fix the toner images on the recording medium. The fixing unit includes a pressure fixing device and a heat fixing device. The pressure fixing device is adapted to fix the toner including the pressure-induced phase transition resin on the recording medium by applying a temperature Tb and a pressure Pb thereto in a pressure fixing nip. The heat fixing device is adapted to fix the toner including the thermoplastic resin on the recording medium by applying a temperature Ta and a pressure Pa thereto in a heat fixing nip. The image forming apparatus satisfies the following inequations: Tb<Ta and Pb>Pa. The toner including the pressure-induced phase transition resin is contained in at least one of the developing devices and the toner including the thermoplastic resin is contained in at least one of the developing devices.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
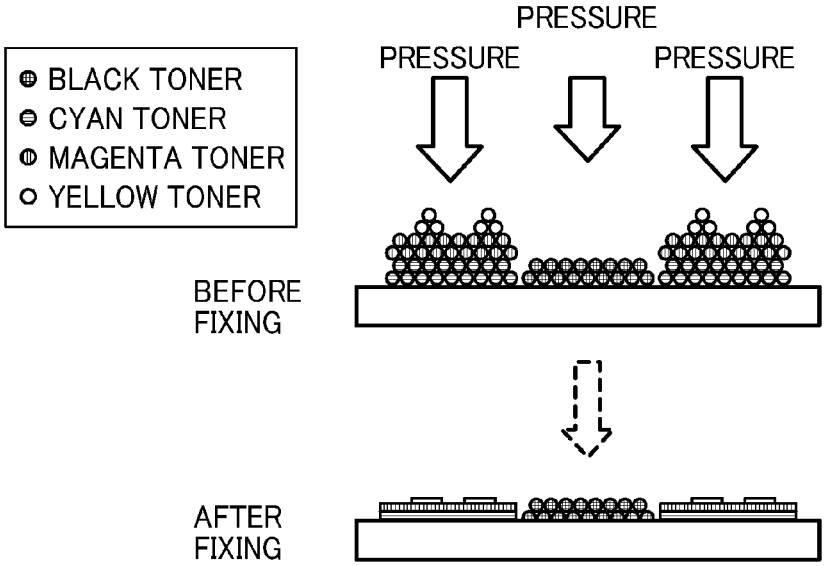
FIG. 1 RELATED ART
FIG. 1 is a schematic view illustrating a related-art process of fixing a full-color toner image on a recording medium.
Figure 2:
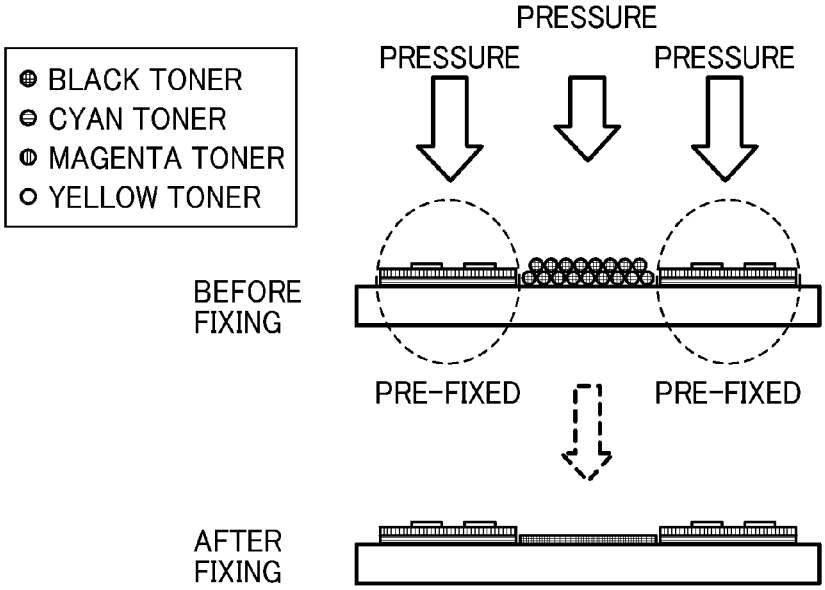
FIG. 2 RELATED ART
FIG. 2 is a schematic view illustrating another related-art process of fixing a full-color toner image on a recording medium.
Figure 3:
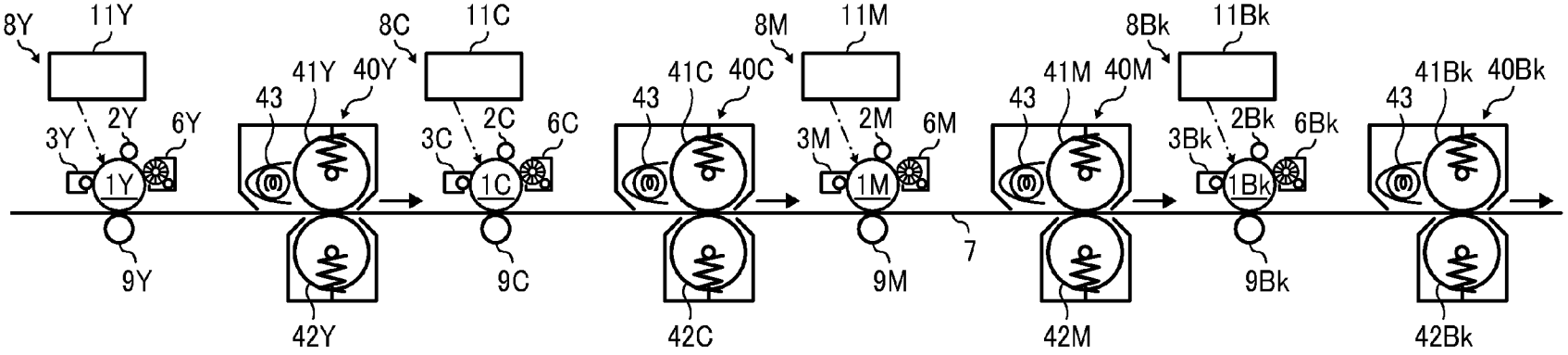
FIG. 3 RELATED ART
FIG. 3 is a schematic view of a related-art image forming apparatus.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

Figure 4:
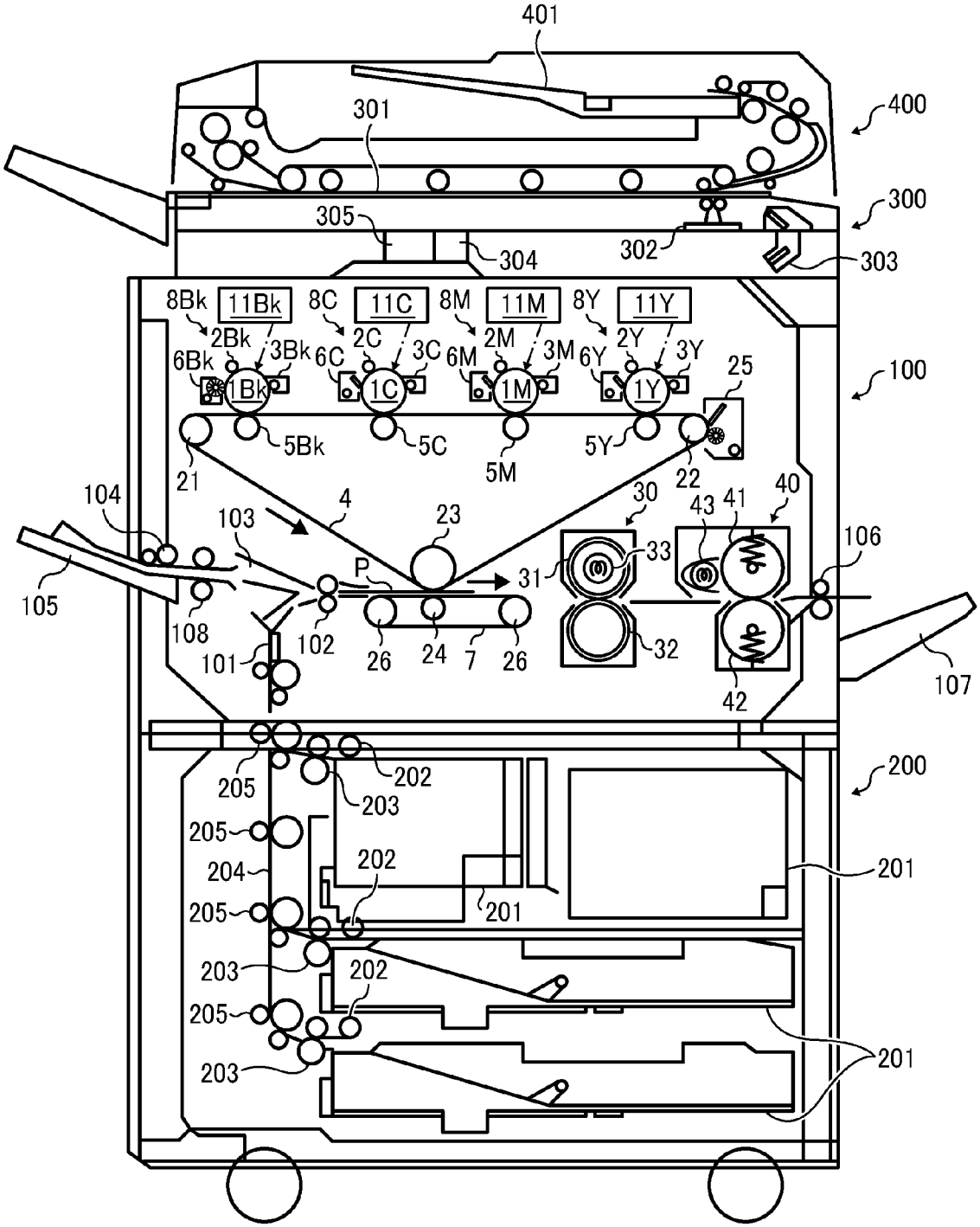
FIG. 4 is a schematic view of an image forming apparatus according to an embodiment.

FIG. 4 is a schematic view of an image forming apparatus according to an embodiment.

The image forming apparatus illustrated in FIG. 4 is a tandem-type full-color copier. The image forming apparatus includes a main body 100, a paper feed table 200 disposed below the main body 100, a scanner 300 disposed above the main body 100, and an automatic document feeder 400 disposed above the scanner 300. The image forming apparatus further includes a seamless-belt intermediate transfer medium 4 and imaging units adapted to from images of yellow, magenta, cyan, and black. Each of the imaging units includes a developing device containing a toner including a thermoplastic resin (hereinafter "thermoplastic resin toner") or a toner including a pressure-induced phase transition resin (hereinafter "pressure-induced phase transition resin toner"). Hereinafter, reference numerals with additional characters of Y, M, C, and K, representing the color of yellow, magenta, cyan, and black, respectively, relate to the thermoplastic resin toners, and those with an additional character of Bk, representing the color of black, relates to the pressure-induced phase transition resin toner.

In the main body 100, the intermediate transfer medium 4, serving as a second image bearing member, is stretched across a driving roller 21, a driven roller 22, and a secondary transfer facing roller 23 and is rotatable counterclockwise in FIG. 4. Imaging units 8Y, 8M, and 8C are disposed facing a surface of the intermediate transfer medium 4 stretching between the driving roller 21 and the driven roller 22 in this order from an upstream side of the surface relative to the direction of movement of the intermediate transfer medium 4. The imaging units 8Y, 8M, and 8C contain thermoplastic resin toners for forming images of yellow, magenta, and cyan, respectively. The imaging units 8Y, 8M, and 8C have the same configuration except for containing respective thermoplastic resin toners of different colors. Drum-shaped photoreceptors 1Y, 1M, and 1C, serving as first image bearing members, are arranged in parallel. The photoreceptors 1Y, 1M, and 1C are rotatable clockwise in FIG. 4. Around the photoreceptors 1Y, 1M, and 1C, chargers 2Y, 2M, and 2C and developing devices 3Y, 3M, and 3C are disposed, respectively. The chargers 2Y, 2M, and 2C are adapted to electrostatically charge the photoreceptors 1Y, 1M, and 1C, respectively. The developing devices 3Y, 3M, and 3C are adapted to develop electrostatic latent images formed on the photoreceptors 1Y, 1M, and 1C, respectively, into toner images with the respective thermoplastic resin toners. Photoreceptor cleaners 6Y, 6M, and 6C are also disposed around the photoreceptors 1Y, 1M, and 1C, respectively. The photoreceptor cleaners 6Y, 6M, and 6C are adapted to remove residual toner particles remaining the photoreceptors 1Y, 1M, and 1C, respectively.

Each of the photoreceptor cleaners 6Y, 6M, and 6C may include, for example, a blade comprised of a rubber material such as urethane rubber. The blade is pressed against the photoreceptor 1Y, 1M, or 1C to remove toner particles therefrom. The image forming apparatus has a mechanism for collecting toner particles removed by the blade into a waste toner tank. The image forming apparatus may include a lubricant applicator that applies a lubricant to each of the photoreceptors 1Y, 1M, and 1C for the purpose of improving cleanability or protecting the photoreceptors 1Y, 1M, and 1C. The lubricant may be comprised of a metal salt of a fatty acid, such as zinc stearate and calcium stearate.

The image forming apparatus further includes an imaging unit 8Bk containing a pressure-induced phase transition resin toner for forming black image. The imaging unit 8Bk is disposed in tandem with the imaging units 8Y, 8M, and 8C at the most downstream side relative to the direction of movement of the intermediate transfer medium 4. The imaging units 8Y, 8M, and 8C containing thermoplastic resin toners and the imaging unit 8Bk containing a pressure-induced phase transition resin toner form a hybrid imaging engine. The imaging unit 8Bk includes a drum-shaped photoreceptor 1Bk serving as a first image bearing member. The photoreceptor 1Bk is rotatable clockwise in FIG. 4. Around the photoreceptor 1Bk, a charger 2Bk and a developing device 3Bk are disposed. The charger 2Bk is adapted to electrostatically charge the photoreceptor 1Bk. The developing device 3Bk is adapted to develop an electrostatic latent image formed on the photoreceptor 1Bk into a toner image with the pressure-induced phase transition resin toner. A photoreceptor cleaner 6Bk is also disposed around the photoreceptor 1Bk. The photoreceptor cleaner 6Bk is adapted to remove residual toner particles from the photoreceptor 1Bk.

According to an embodiment, the photoreceptor cleaner 6Bk has a configuration such that toner particles to be removed are subjected to less stress. For example, the photoreceptor cleaner 6Bk may include a rotatable brush. The brush may be comprised of an insulating material such as nylon, polyester, and acrylic. The brush may be supplied with a voltage having the same or opposite polarity to the toner particles for the purpose of further improving cleanability. The image forming apparatus has a mechanism for collecting toner particles removed by the photoreceptor cleaner 6Bk into a waste toner tank. The image forming apparatus may include a lubricant applicator that applies a lubricant to the photoreceptor 1Bk for the purpose of improving cleanability or protecting the photoreceptor 1Bk.

According to an embodiment illustrated in FIG. 4, the imaging unit 8Bk, which is most frequently used, is disposed at the most downstream side among the imaging units 8Y, 8M, 8C, and 8Bk so that the first printing speed of the imaging unit 8Bk gets the shortest. However, the arrangement order of the imaging units 8Y, 8M, 8C, and 8Bk is not limited thereto. According to another embodiment, the imaging unit 8Bk is disposed at the most upstream side among the imaging units 8Y, 8M, 8C, and 8Bk so that the toners of yellow, magenta, and cyan are prevented from being reversely transferred onto the photoreceptor 1Bk in the imaging unit 8Bk, which improves cleanability of the photoreceptor 1Bk and makes the black toner recyclable. Primary transfer rollers 5Y, 5M, 5C, and 5Bk are pressed against the photoreceptors 1Y, 1M, 1C, and 1Bk, respectively, with the intermediate transfer medium 4 therebetween to define respective primary transfer positions. Each of the primary transfer rollers 5Y, 5M, 5C, and 5Bk is to be supplied with a primary transfer bias.

A belt cleaner 25 is disposed facing the driven roller 22. The belt cleaner 25 is adapted to clean the surface of the intermediate transfer medium 4. The belt cleaner 25 includes a cleaning brush on an upstream side and a cleaning blade on a down stream side relative to the direction of movement of a surface of the intermediate transfer medium 4 stretched by the driven roller 22. The cleaning blade may be comprised of a rubber material such as urethane rubber. The cleaning brush is adapted to remove the pressure-induced phase transition resin toner without applying pressure thereto and the cleaning blade is adapted to remove the thermoplastic resin toner thereafter. The image forming apparatus has a mechanism for collecting toner particles removed by the belt cleaner 25 into a waste toner tank. The image forming apparatus may include a lubricant applicator that applies a lubricant, such as a metal salt of a fatty acid, to the intermediate transfer medium 4 for the purpose of improving cleanability or protecting the photoreceptor 1Bk.

The imaging units 8Y, 8M, 8C, and 8Bk include writing devices 11Y, 11M, 11C, and 11Bk, respectively, adapted to form an electrostatic latent image on the photoreceptors 1Y, 1M, 1C, and 1Bk, respectively. A secondary transfer roller 24 is disposed facing the secondary transfer facing roller 23 with the intermediate transfer medium 4 and a recording medium conveying belt 7 therebetween. The secondary transfer roller 24 is to be supplied with a secondary transfer bias. Multiple color toners are sequentially transferred onto the intermediate transfer medium 4 to form a composite toner image. The composite toner image is then electrostatically transferred onto a recording medium P at a secondary transfer nip where the secondary transfer facing roller 23 and the secondary transfer roller 24 meet and press against each other. The recording medium P is conveyed to the secondary transfer nip by the recording medium conveying belt 7. The recording medium conveying belt 7 is stretched across a pair of tension rollers 26 and the secondary transfer roller 24. The recording medium conveying belt 7 controls entry behavior of the recording medium P into the secondary transfer nip and into a fixing unit.

A place where a fixing member and a pressing member meet and press against each other is a so-called nip portion, hereinafter called a fixing nip or simply nip. In the present embodiment, the fixing unit includes a heat fixing nip for fixing the thermoplastic resin toner and a pressure fixing nip for fixing the pressure-induced phase transition resin toner. Referring to FIG. 4, the fixing unit includes a heat fixing device 30 having the heat fixing nip on an upstream side and a pressure fixing device 40 having the pressure fixing nip on a downstream side relative to the direction of conveyance of the recording medium P.

The heat fixing device 30 is adapted to fix the thermoplastic resin toner on the recording medium P. The heat fixing device 30 includes a fixing roller 31 and a pressing roller 32. The fixing roller 31 is a rotatable roller member. The pressing roller 32 is pressed against the fixing roller 31 with a biasing member. The heat fixing device 30 further includes a moving device adapted to form the heat fixing nip while a toner image is being fixed on the recording medium P and not to form the heat fixing nip while no toner image is being fixed on the recording medium P. Each of the fixing roller 31 and the pressing roller 32 includes a metallic cored bar, an elastic layer disposed on the metallic cored bar, and a release layer disposed on the elastic layer. The metallic cored bar may be comprised of aluminum, SUS, etc. The elastic layer may be comprised of a silicone rubber, etc. The release layer may be comprised of a fluorine-containing resin such as PFA and PTFE. According to an embodiment, the fixing roller 31 contains a halogen heater 33. According to another embodiment, the fixing roller 31 may be heated by means of electromagnetic induction. For example, electromagnetic induction occurs when the fixing roller 31 includes a magnetic cored bar or a magnetic layer and an IH coil is provided facing an outer peripheral surface of the fixing roller 31 while forming a predetermined gap therebetween.

When a thermoplastic resin toner image (i.e., a color toner image) is being fixed on the recording medium P, the fixing roller 31 and the pressing roller 32 are in contact with each other to form the heat fixing nip and apply heat and pressure to the thermoplastic resin toner image. In some embodiments, the temperature Ta and the pressure Pa in the heat fixing nip are 100 to 200° C. and 0.2 to 2 kgf/cm$^2$, respectively.

The pressure fixing device 40 is adapted to fix the pressure-induced phase transition resin toner on the recording medium P. The pressure fixing device 40 includes a pair of metallic pressing rollers 41 and 42 having smooth surfaces. Both ends of the rotation axis of each of the pressing rollers 41 and 42 are biased by a compression spring. The pressure fixing device 40 further includes a moving device adapted to form the pressure fixing nip while a toner image is being fixed on the recording medium P and not to form the pressure fixing nip while no toner image is being fixed on the recording medium P. When a pressure-induced phase transition resin toner image is being fixed on the recording medium P, the pressing rollers 41 and 42 are in contact with each other to form the pressure fixing nip and apply heat and pressure to the pressure-induced phase transition resin toner image. In some embodiments, the temperature Tb and the pressure Pb in the pressure fixing nip are 15 to 100° C. and 5 to 500 kgf/cm$^2$, respectively. The temperatures Ta and Tb and the pressures Pa and Pb are not limited to the above-described values. In one or more embodiments, the following inequations are satisfied: Tb<Ta and Pb>Pa.

In the pressure fixing nip, the pressing rollers 41 and 42 are not necessarily in complete contact with each other and may form a gap G. The distance of the gap G is shorter than the thickness of the recording medium P. By forming the gap G between the pressing rollers 41 and 42, the pressing rollers 41 and 42 are prevented from being scratched with foreign substances get stuck in the pressure fixing nip, thus improving lifespan of the pressing rollers. In a case in which the pressing rollers 41 and 42 are in contact with each other at a high pressure, it is likely that a recording medium having a low stiffness gets wrinkles and tears from the wrinkles. In the pressure fixing nip according to an embodiment, the recording medium P is applied with a relatively small pressure and therefore less damaged. Thus, a recording medium P is prevented from getting wrinkles and tearing from the wrinkles. When a pressure-induced phase transition resin toner image does not exist on the recording medium P, the distance of the gap G between the pressing rollers 41 and 42 is made longer than the thickness of the recording medium P so that the pressure fixing nip is not formed.

In one or more embodiments, the pressure-induced phase transition resin toner is fixable on the recording medium P without being applied with heat, which is advantageous in terms of energy saving. In some embodiments, the pressure-induced phase transition resin toner is auxiliary applied with heat when fixed on the recording medium P. Referring to FIG. 4, a halogen heater 43 equipped with a radiation plate is disposed facing the pressing roller 41. The halogen heater 43 is adapted to heat the pressing roller 41 by radiation heat at an upstream side from the pressure fixing nip.

In one or more embodiments, the following inequations are satisfied: Tb<Ta and Pb>Pa. The inequations mean that the pressure-induced phase transition resin toner is applied with a lower temperature and a higher pressure and the thermoplastic resin toner is applied with a higher temperature and a lower pressure when being fixed on the recording medium P. Even when an unfixed pressure-induced phase transition resin toner enters into the heat fixing nip, the pressure-induced phase transition resin toner is prevented from retransferred onto the fixing roller 31.

Figure 5:
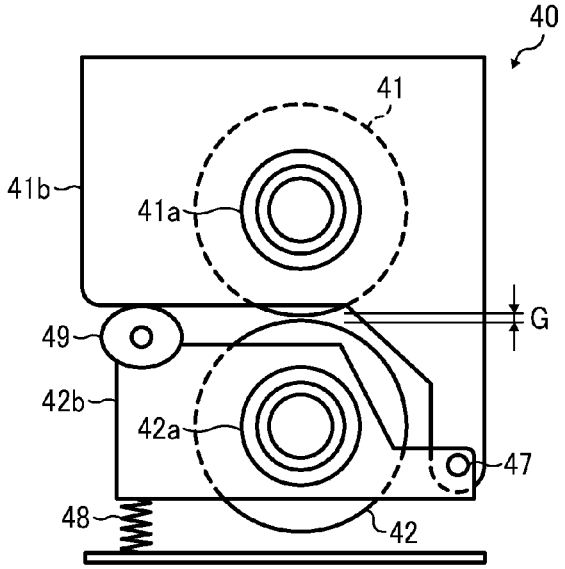
FIG. 5 is a schematic view of a pressure fixing device according to an embodiment.

FIG. 5 is a schematic view of the pressure fixing device 40 viewed from one axial end. The pressure fixing device 40 includes, as described above, the moving device that arbitrarily moves the pressing rollers 41 and 42 to form the pressure fixing nip therebetween. The moving device includes a spring 48 that biases axial ends of the pressing rollers 41 and 42 so that the pressure fixing nip having the gap G is formed between the pressing rollers 41 and 42. The moving device further includes a lower roller ends supporting member 42*b*. One end of the lower roller ends supporting member 42*b* is rotatably supported by a supporting point 47 of the casing of the pressure fixing device 40. The other end of the lower roller ends supporting member 42*b* is supported by the spring 48. The lower roller ends supporting member 42*b* supports bearings 42*a* of the pressing roller 42 at a substantially center point thereof. The moving device further includes an upper roller ends supporting member 41*b*. One end of the upper roller ends supporting member 41*b* is rotatably supported by the supporting point 47 of the casing of the pressure fixing device 40. The other end of the upper roller ends supporting member 41*b* is supported by a cam 49. The upper roller ends supporting member 41*b* supports bearings 41*a* of the pressing roller 41 at a substantially center point thereof. The cam 49 is an ellipsoidal member disposed adjacent to an upper end and the spring 48 side of the lower roller ends supporting member 42*b*. The upper roller ends supporting member 41*b* presses against the cam 49 so that the gap G is constantly formed between the pressing rollers 41 and 42.

The cam 49 is driven to rotate by a driving device. As the cam 49 rotates, the pressing rollers 41 and 42 get close to each other so that the gap G having a predetermined distance is formed therebetween (i.e., the pressure fixing nip is formed) or get away from each other so that a toner-image-carrying-surface of the recording medium P is not brought into contact with the peripheral surface of the pressing roller 41 (i.e., the pressure fixing nip is not formed). In some embodiments, the heat fixing device 30 also includes a moving device including a spring and a cam. The moving device arbitrarily moves the fixing roller 31 and the pressing roller 32 to form the heat fixing nip therebetween. According to the above embodiments, the recording medium P avoids passing an unnecessary fixing nip, thus reducing noise and suppressing formation of abnormal image.

A copying operation of the image forming apparatus illustrated in FIG. 4 is described below. First, a document is set on a document table 401 of the automatic document feeder 400. Alternatively, a document is set on a contact glass 301 of the scanner 300 while the automatic document feeder 400 is lifted up. The automatic document feeder 400 is then held down. Upon pressing of a start switch by a user, in a case in which a document is set to the automatic document feeder 400, the document is fed onto the contact glass 301. The scanner 300 starts driving so that a first runner 302 and a second runner 303 start moving. The first runner 302 directs light to the document on the contact glass 301 and a light reflected from the document is reflected by a mirror in the second runner 303. The reflected light is guided to a reading sensor 305 through an imaging lens 304. Thus, image information is read.

On the other hand, upon pressing of the start switch by the user, a driving motor starts driving to drive the driving roller 21 as well as the intermediate transfer medium 4 to rotate. At the same time, the photoreceptors 1Y, 1M, 1C, and 1Bk and the recording medium conveying belt 7, stretched taut by the secondary transfer roller 24, start driving. The intermediate transfer medium 4, the photoreceptors 1Y, 1M, 1C, and 1Bk, and the recording medium conveying belt 7 are controlled so that each of them has a constant speed relative to each other. The writing devices 11Y, 11M, 11C, and 11Bk direct light to the photoreceptors 1Y, 1M, 1C, and 1Bk having been charged by the chargers 2Y, 2M, 2C, and 2Bk, respectively, based on the image information read by the reading sensor 305.

As a result, an electrostatic latent image is formed on each of the photoreceptors 1Y, 1M, 1C, and 1Bk and is developed into a toner image by each of the developing devices 3Y, 3M, 3C, and 3Bk. Yellow, magenta, cyan, and black toner images are formed on the photoreceptors 1Y, 1M, 1C, and 1Bk, respectively. The yellow, magenta, cyan, and black toner images are sequentially transferred onto the intermediate transfer medium 4 by the primary transfer rollers 5Y, 5M, 5C, and 5Bk, respectively, supplied with charge. Thus, a composite toner image, in which the yellow, magenta, cyan, and black toner images are superimposed on one another, is formed on the intermediate transfer medium 4. After the composite toner image is transferred from the intermediate transfer medium 4, residual toner particles remaining on the intermediate transfer medium 4 are removed by the belt cleaner 25.

On the other hand, upon pressing of the start switch by the user, one of paper feed rollers 202 starts rotating in the paper feed table 200 so that the recording medium P is fed from one of paper feed cassettes 201 according to the designation of the user. A sheet of the recording medium P is separated by one of separation rollers 203 and is introduced to a paper feed path 204. Feed rollers 205 then feed the sheet to a paper feed path 101 in the main body 100. The sheet of the recording medium P is stopped by a registration roller 102. Alternatively, the recording medium P may be fed from a manual feed tray 105 by rotating a paper feed roller 104. A sheet of the recording medium P is separated by a separation roller 108 and is fed to a manual paper feed path 103. The sheet of the recording medium P is stopped by a registration roller 102.

The registration roller 102 starts rotating in synchronization with an entry of the composite toner image formed on the intermediate transfer medium 4 into the secondary transfer nip. In the present embodiment, the registration roller 102 is grounded. In some embodiments, the registration roller 102 is supplied with a bias for the purpose of removing paper powders from the recording medium P. The bias supplied to the registration roller 102 may be either a DC voltage or an AC voltage having a DC offset component. The latter more uniformly charges the recording medium P. After passing through the registration roller 102 supplied with the bias, the recording medium P gets slightly negatively charged. Therefore, in a case in which a toner image is transferred from the intermediate transfer medium 4 onto the recording medium P which have passed through the registration roller 102 supplied with the bias, transfer conditions should be changed accordingly from a case in which the registration roller 102 is not supplied with the bias.

The registration roller 102 feeds the recording medium P to the secondary transfer nip, defined between the secondary transfer roller 24 and the intermediate transfer medium 4, by the recording medium conveying belt 7. In the secondary transfer nip, the composite toner image is transferred from the intermediate transfer medium 4 onto the recording medium P by a secondary transfer bias supplied to the secondary transfer roller 24. The recording medium P having the composite toner image thereon is fed to the heat fixing device 30. In the heat fixing device 30, the thermoplastic resin toner included in the composite toner image is fixed on the recording medium P by application of heat under a predetermined pressure. The recording medium P is then fed to the pressure fixing device 40. In the pressure fixing device 40, the pressure-induced phase transition resin toner included in the composite toner image is fixed on the recording medium P by application of pressure under a predetermined temperature. The recording medium P is then discharged onto a discharge tray 107 by a discharge roller 106.

According to an embodiment, the pressure-induced phase transition resin toner includes a resin having a micro phase separation structure, such as a block copolymer and a resin particle having a core-shell structure (hereinafter "core-shell resin particle"). The block copolymer may comprise, for example, a hard segment having a high glass transition temperature and a soft segment having a low glass transition temperature or melting point. In the core-shell resin particle, for example, one of the core and the shell may comprise a hard segment having a high glass transition temperature and the other may comprise a soft segment having a low glass transition temperature or melting point. Such resins (i.e., the block copolymer and the core-shell resin particle) express fluidity under pressure stimuli. Therefore, such resins can express a desired fluidity in the pressure fixing nip.

Specific examples of such resins include, but are not limited to, resins prepared by polycondensation and resins prepared by radical polymerization of an ethylene-based unsaturated monomer. Resins prepared by polycondensation are described in, for example, the technical documents entitled "Polycondensation" (Ogata, N., Kagakudoujin (1971)) and "Polyester Resin Handbook" (Takiyama, E., The Nikkan Kogyo Shimbun, Ltd. (1998)). Such resins can also be prepared by ester exchange or direct polycondensation, or a combination thereof. Specific examples of such resins include polyester resins. The block copolymer can be prepared by living anionic polymerization of an ethylene-based unsaturated monomer. The core-shell resin particle can be prepared by a method called two stage feed method in which monomers are supplied to a polymerization system in a step-by-step manner so that a nano-sized particle having a core and a shell, having different glass transition temperature from each other, is formed. In this specification, the glass transition temperature (Tg) is determined by differential scanning calorimetry (DSC) based on a method according to ASTM D3418-82. In the method, a sample is heated from −80 to 140° C. at a heating rate of 10° C./min. In some embodiments, the hard segment has a glass transition temperature of 45 to 120° C., or 50 to 110° C. In some embodiments, the glass transition temperature of the soft segment is 20° C. or more, or 30° C. or more, lower than that of the hard segment so that the resin can more effectively express fluidity by pressure stimuli.

The block copolymer and the polyester resin prepared by polycondensation can be formed into a resin particle dispersion by the following procedures (1) to (3), for example.

(1) Disperse a sample in an aqueous medium by a high mechanical shearing force applied from a rotary shear homogenizer, a ball mill, a sand mill, a DYNO MILL, or a pressure discharge disperser such as GAULIN HOMOGENIZER. ("Shear emulsification process")

(2) Dissolve a sample in an organic solvent and mix the resulting solution with an aqueous medium to cause phase-transfer emulsification. ("Phase-transfer emulsification process")

(3) Mix the block copolymer or a precursor thereof (e.g., a living terminal low-molecular-weight body or a block) with a small amount of an ethylene-based unsaturated compound. Subject the mixture to the shear emulsification process or the phase transfer process, and further mini emulsion polymerization or suspension polymerization.

The resulting resin particle dispersion can be used for an emulsion aggregation process for preparing toner. In the emulsion aggregation process, appropriate amounts of the resin particle dispersion, a colorant dispersion, and an optional release agent dispersion are mixed.

In the mixed dispersion, the dispersed materials, i.e., resin particles, colorant particles, and release agent particles, are aggregated (or associated) while the particle size and particle size distribution of the aggregated particles are controlled. More specifically, an aggregating agent is added to the mixed dispersion so as to cause hetero aggregation and form aggregated particles having a desired toner size. The mixed dispersion is then heated to or above the glass transition temperature or melting point of the resin particle so that the aggregated particles are coalesced, followed by washing and drying. Thus, toner particles are obtained. The toner particles can have various shapes (e.g., an irregular shape, a spherical shape) by varying the heating temperature.

Specific examples of the resins prepared by polycondensation include amorphous polyester resins and crystalline polyester resins. Such polyester resins can be prepared by a direct esterification reaction or an ester exchange reaction of monomers such as polycarboxylic acids, polyols, and hydroxycarboxylic acids. A polycondensation catalyst for accelerating the polycondensation may be used in the polycondensation.

Specific examples of the polycarboxylic acids include, but are not limited to, aliphatic, alicyclic, and aromatic polycarboxylic acids; and alkyl esters, acid anhydrides, and acid halides thereof. Specific examples of the polyols include, but are not limited to, polyols and esters thereof. The alkyl ester may be a lower alkyl ester having 1 to 8 carbon atoms in the alkoxy part. Specific examples of the lower alkyl ester include, but are not limited to, methyl ester, ethyl ester, n-propyl ester, isopropyl ester, n-butyl ester, and isobutyl ester.

The polycarboxylic acid includes at least two carboxyl groups per molecule. Polycarboxylic acids having two carboxyl groups per molecule are so-called dicarboxylic acids. Specific examples of the dicarboxylic acids include oxalic acid, succinic acid, maleic acid, adipic acid, β-methyl adipic acid, azelaic acid, sebacic acid, and nonanedicarboxylic acid. Specific examples of the dicarboxylic acids further include decanedicarboxylic acid, undecanedicarboxylic acid, dodecenyl succinic acid, dodecanedicarboxylic acid, fumaric acid, citraconic acid, diglycol acid, and cyclohexanedicarboxylic acid. Specific examples of the dicarboxylic acids further include cyclohexane-3,5-diene-1,2-dicarboxylic acid, 2,2-dimethylolbutanoic acid, malic acid, citric acid, hexahydroterephthalic acid, malonic acid, pimelic acid, tartaric acid, mucic acid, phthalic acid, and isophthalic acid. Specific examples of the dicarboxylic acids further include terephthalic acid, tetrachlorophthalic acid, chlorophthalic acid, nitrophthalic acid, p-carboxyphenyl acetic acid, p-phenylene diacetic acid, m-phenylene diglycol acid, and p-phenylene diglycol acid. Specific examples of the dicarboxylic acids further include o-phenylene diglycol acid, diphenyl acetic acid, diphenyl-p,p'-dicarboxylic acid, naphthalene-1,4-dicarboxylic acid, naphthalene-1,5-dicarboxylic acid, and naphthalene-2,6-dicarboxylic acid. Specific examples of the dicarboxylic acids further include anthracene dicarboxylic acid and dodecenyl succinic acid.

Specific examples of the polycarboxylic acids other than the dicarboxylic acids include, but are not limited to, trimellitic acid, pyromellitic acid, naphthalenetricarboxylic acid, naphthalenetetracarboxylic acid, pyrenetricarboxylic acid, and pyrenetetracarboxylic acid. Two or more or these polycarboxylic acids can be used in combination.

The polyol includes at least two hydroxyl groups per molecule. Polyols having two hydroxyl groups per molecule are so-called diols. Specific examples of the diols include ethylene glycol, propylene glycol, butanediol, diethylene glycol, triethylene glycol, and hexanediol. Specific examples of the diols further include cyclohexanediol, octanediol, decanediol, dodecanediol, ethylene oxide adduct of bisphenol A, and propylene oxide adduct of bisphenol A. Specific examples of the diols further include bisphenoxy alcohol fluorene (e.g., bisphenoxy ethanol fluorene). Specific examples of the polyols other than the diols include glycerin, pentaerythritol, hexamethylol melamine, and hexaethylol melamine. Specific examples of the polyols other than the diols further include tetramethylol benzoguanamine and tetraethylol benzoguanamine. Two or more or these polyols can be used in combination.

The ethylene-based unsaturated monomer includes at least one ethylene-based unsaturated bond and an optional hydrophilic group. Specific examples of the ethylene-based unsaturated monomer include, but are not limited to, styrenes such as styrene, p-chlorostyrene, and α-methylstyrene; acrylates and methacrylates such as methyl acrylate, ethyl acrylate, propyl acrylate, butyl acrylate, lauryl acrylate, 2-ethylhexyl acrylate, methyl methacrylate, ethyl methacrylate, propyl methacrylate, butyl methacrylate, hexyl methacrylate, lauryl methacrylate, and 2-ethylhexyl methacrylate; ethylene-based unsaturated nitriles such as acrylonitrile and methacrylonitrile; ethylene-based unsaturated carboxylic acids such as acrylic acid, methacrylic acid, and crotonic acid; vinyl ethers such as vinyl methyl ether and vinyl isobutyl ether; vinyl ketones such as vinyl methyl ketone, vinyl ethyl ketone, and vinyl isopropenyl ketone; olefins such as isoprene, butene, and butadiene; and β-carboxyethyl acrylate. Homopolymers and copolymers of the above monomers and mixtures thereof are usable.

The hydrophilic group may be, for example, an acidic polar group such as carboxyl group, sulfo group, and phosphonyl group; a basic polar group such as amino group; or a neutral polar group such as amide group, hydroxyl group, cyano group, and formyl group. In some embodiments, the ethylene-based unsaturated monomer includes an acidic polar group. A resin particle having an adequate amount of such monomer having both an acidic polar group and an ethylene-based unsaturated bond on its surface is cohesive and chargeable. Such resin particle is applicable to toner. In some embodiments, the acidic group is carboxyl group or sulfo group. Specific examples of such monomers include, but are not limited to, α,β-ethylene-based unsaturated compounds having carboxyl group and α,β-ethylene-based unsaturated compounds having sulfo group. Specific examples of the α,β-ethylene-based unsaturated compounds having carboxyl group include, but are not limited to, acrylic acid, methacrylic acid, fumaric acid, maleic acid, itaconic acid, and cinnamic acid. Specific examples of the α,β-ethylene-based unsaturated compounds having carboxyl group further include monomethyl maleate, monobutyl maleate, and monooctyl maleate. Two or more of these monomers can be used in combination.

In some embodiments, the toner includes a resin having a glass transition temperature of 40° C. or more. The resin may be a random copolymer of an ethylene-based unsaturated monomer. Additionally, the resin may be a copolymer including 0.1 to 10% by mol of the segment from an ethylene-based unsaturated monomer having a hydrophilic group. In these embodiments, the resin having a glass transition temperature of 40° C. or more readily forms a shell layer in the resulting toner when the toner is prepared in an aqueous medium. In some embodiments, the content of the resin having a glass transition temperature of 40° C. or more, such as a polymer of an ethylene-based unsaturated monomer or a polycondensation resin such as a polyester resin, is 50% by weight or less, or 5 to 20% by weight, based on total weight of the all binder resins. In these embodiments, the toner is so durable that high quality images are reliably formed.

Usable colorants are described in detail below. Usable black colorants include, but are not limited to, carbon black, copper oxide, manganese dioxide, aniline black, activated carbon, non-magnetic ferrite, and magnetite. Usable yellow colorants include, but are not limited to, chrome yellow, zinc yellow, yellow iron oxide, cadmium yellow, chrome yellow, Hansa Yellow, Hansa Yellow 10G, Benzidine Yellow G, Benzidine Yellow GR, threne yellow, quinoline yellow, and Permanent Yellow NCG. Usable orange colorants include, but are not limited to, chrome orange, molybdenum orange, Permanent Orange GTR, pyrazolone orange, Vulcan orange, Benzidine Orange G, Indanthrene Brilliant Orange RK, and Indanthrene Brilliant Orange GK.

Usable red colorants include, but are not limited to, colcothar, cadmium red, red lead, mercury sulfide, Watching Red, Permanent Red 4R, Lithol Red, Brilliant Carmine 3B, Brilliant Carmine 6B, Dupont Oil Red, pyrazolone red, Rhodamine B Lake, Lake Red C, rose bengal, eosin red, and alizarin lake. Usable blue colorants include, but are not limited to, iron blue, cobalt blue, alkali blue lake, Victoria blue lake, fast sky blue, Indanthrene Blue BC, aniline blue, ultramarine blue, Calco Oil Blue, methylene blue chloride, phthalocyanine blue, phthalocyanine green, and malachite green oxalate. Usable violet colorants include, but are not limited to, manganese violet, Fast Violet B, and methyl violet lake. Usable green colorants include, but are not limited to, chromium oxide, chrome green, Pigment Green, malachite green lake, and Final Yellow Green G. Usable white colorants include, but are not limited to, zinc flower, titanium oxide, antimony white, and zinc sulfide. Two or more of these colorants can be used in combination.

A colorant dispersion can be prepared with, for example, a rotary shear homogenizer, a media disperser (e.g., a ball mill, a sand mill, an attritor), a high-pressure opposed collision type disperser, or a DYNO MILL. In preparing a colorant dispersion, for example, a colorant is dispersed in an aqueous medium containing a polar surfactant with a homogenizer, optionally together with other components, either all at once or in a step-by-step manner. A colorant to be used is selected in consideration of color hue angle, color saturation, brightness, resistance to climatic conditions, OHP permeability, and dispersibility in the toner. The content of the colorant may be 4 to 15% by weight based on total weight of solid contents in the toner. When a magnetic material is used as a black colorant, the content thereof may be 12 to 240% by weight based on total weight of solid contents in the toner. Within the above ranges, the toner produces great color after being fixed on a recording medium. When the colorant particles are dispersed in the toner with a median diameter of 100 to 330 nm, the toner produces great color after being fixed on a recording medium, in particular, great transparency after being fixed on an OHP sheet. The median diameter of the colorant particles can be measured by a Particle Size Distribution Analyzer LA-920 (from Horiba, Ltd.), for example.

Usable release agents are described in detail below. Specific examples of usable release agents include, but are not limited to, ester waxes, low-molecular-weight polyolefins (e.g., polyethylene, polypropylene, polybutene), and silicones which express softening point upon application of heat. Specific examples of usable release agents further include fatty acid amides such as oleic acid amide, erucic acid amide, ricinoleic acid amide, and stearic acid amide. Specific examples of usable release agents further include plant waxes such as carnauba wax, rice wax, candelilla wax, sumac wax, and jojoba oil; and animal waxes such as bees wax. Specific examples of usable release agents further include mineral and petroleum waxes such as montan wax, ozokerite, ceresin, paraffin wax, microcrystalline wax, Fischer-Tropsch wax, and modified products thereof. These waxes are practically insoluble or slightly soluble in solvents, such as toluene, at room temperatures.

In preparing a release agent dispersion, a release agent is dispersed in water with an ionic surfactant or a polyelectrolyte (e.g., polymeric acid, polymeric base) while being heated to or above the melting point and applied with a strong shearing force from a homogenizer or a pressure discharge disperser (such as GAULIN HOMOGENIZER). The resulting dispersion contains submicron release agent particles. The content of the release agent may be 5 to 25% by weight based on total weight of solid contents in the toner so as to improve releasability of a fixed toner image from a recording medium in oilless fixing systems. The diameter of the release agent particles can be measured by a Particle Size Distribution Analyzer LA-920 (from Horiba, Ltd.), for example. In some embodiments, after the resin particles, colorant particles, and release agent particles are aggregated in the mixed dispersion, the resin particle dispersion is further added thereto to further adhere the resin particles to the aggregated particles for the purpose of improving chargeability and durability of the toner.

Specific examples of usable magnetic materials include, but are not limited to, materials magnetizable in a magnetic field, such as ferromagnetic powders (e.g., iron, cobalt, nickel), ferrites, and magnetites. When the toner is prepared in an aqueous medium, the magnetic material may be hydrophobized previously so as not to migrate to the aqueous medium.

Specific examples of usable charge controlling agents include, but are not limited to, quaternary ammonium salt compounds, nigrosine dye compounds, aluminum-complex, iron-complex or chromium-complex dyes, and triphenylmethane pigments. Materials which are poorly soluble in water are advantageous in terms of controllability of ionic strength, which has an effect on aggregation stability, and reduction of waste water contamination.

In the processes of polymerization, colorant dispersion, preparation and dispersion of resin particles, release agent dispersion, aggregation, etc., the following surfactants can be used. For example, anionic surfactants such as sulfate-based, sulfonate-based, phosphate-based, and soap-based surfactants; and cationic surfactants such as amine-salt-based and quaternary-ammonium-salt-based surfactants are usable. Additionally, nonionic surfactants such as polyethylene-glycol-based, alkylphenol-ethylene-oxide-adduct-based, and polyol-based surfactants are usable. Usable dispersers include, but are not limited to, a rotary shear homogenizer, a ball mill, a sand mill, a DYNO MILL.

Several methods of preparing the pressure-induced phase transition resin toner according to an embodiment are descried in detail below. Several measuring procedures used in the preparation of the pressure-induced phase transition resin toner are also described in detail below. One of the methods of preparing the pressure-induced phase transition resin toner includes (1) preparing a dispersion of a polymer of an ethylene-based unsaturated monomer and the other includes (2) preparing a dispersion of a polyester resin.

In the descriptions in the following examples, the numbers represent weight ratios in parts, unless otherwise specified.

Weight average molecular weight (Mw) and number average molecular weight (Mn) of resins are measured by gel permeation chromatography (GPC) in the following procedure. First, a solvent (tetrahydrofuran) is flowed at a flow rate of 1.2 ml/min at a temperature of 40° C., and 3 mg of a tetrahydrofuran solution containing 0.2 g/20 ml of a sample is injected. Measuring conditions are determined so that the molecular weight of the sample gets within a linear range of a calibration curve compiled from a relation between logarithm of molecular weights of several monodisperse polyethylene standard samples and count numbers. Reliability of the calibration curve is determined based on whether the weight average molecular weight (Mw) and number average molecular weight (Mn) of the polystyrene standard sample NBS706 is calculated as $28.8\times10^4$ and $13.7\times10^4$, respectively. In the GPC measurement, columns TSK-GEL, GMH (from Tosoh Corporation) are used.

Glass transition temperature (Tg) of resins are measured by a differential scanning calorimeter DSC/RDC220 (from Seiko Instruments Inc.). Diameters of resin particles in a resin particle dispersion are measured by a Particle Size Distribution Analyzer LA-920 (from Horiba, Ltd.). Diameters of toner particles, carrier particles, and developer particles are measured by a COULTER MULTISIZER II (from Beckman Coulter, Inc.).

Preparation of Resin Particle Dispersion (1): A resin particle dispersion (1) containing resin particles prepared from an ethylene-based unsaturated monomer is prepared as follows. A separable flask is equipped with 300 parts of ion-exchange water and 1.5 parts of TTAB (i.e., tetradecyl trimethyl ammonium bromide, from Sigma-Aldrich Co. LLC.). The air in the flask is replaced with nitrogen for 20 minutes. The mixture is then heated to 65° C. while being agitated. Thereafter, 40 parts of n-butyl acrylate monomer are added to the flask and the mixture is agitated for 20 minutes. Further, a polymerization initiator solution, in which 0.5 parts of a polymerization initiator V-50 (i.e., 2,2'-azobis(2-methylpropionamidine) dihydrochloride, from Wako Pure Chemical Industries, Ltd.) are dissolved in 10 parts of ion-exchange water, is added to the flask. The mixture is kept heated at 65° C. for 3 hours. An emulsion, in which 61 parts of styrene monomer, 9 parts of n-butyl acrylate monomer, 2 parts of acrylic acid, and 0.8 parts of dodecanethiol are dissolved in 100 parts of ion-exchange water, is continuously dropped in the flask with a metering pump over a period of 2 hours. Thereafter, the mixture is heated to 70° C. for 2 hours to terminate the polymerization.

Thus, a resin particle dispersion (1) containing 25% by weight of core-shell type resin particles having a weight average molecular weight (Mw) of 25,000 and an average particle diameter of 150 nm is prepared. The resin particle dispersion (1) is air-dried at 40° C. to isolate the resin particles. The resin particles are subjected to a DSC measurement within a temperature range of −80 to 140° C. As a result, a glass transition point of a polybutyl acrylate is observed at around a temperature of −50° C. Additionally, a glass transition point of a copolymer of styrene, butyl acrylate, and acrylic acid is observed at around a temperature of 60° C.

Preparation of Colorant Particle Dispersion (C1): A cyan colorant particle dispersion (C1) is prepared as follows. First, 100 parts of a cyan pigment (i.e., copper phthalocyanine C.I. Pigment Blue 15:3, from Dainichiseika Color & Chemicals Mfg. Co., Ltd.), 10 parts of an anionic surfactant (NEOGEN R from Dai-ichi Kogyo Seiyaku Co., Ltd.), and 400 parts of ion-exchange water are mixed. The mixture is subjected to a dispersion treatment with a homogenizer (ULTRA-TURRAX® from IKA) for 15 minutes and another dispersion treatment with an ultrasonic bath for 10 minutes. Thus, a cyan colorant particle dispersion (C1) containing 21.5% of cyan colorant particles having a median diameter of 210 nm is prepared.

Preparation of Release Agent Particle Dispersion (R1): A release agent particle dispersion (R1) is prepared as follows. First, 800 parts of ion-exchange water, 2 parts of an anionic surfactant (NEOGEN R from Dai-ichi Kogyo Seiyaku Co., Ltd.), and 215 parts of a carnauba wax are mixed. The mixture is heated to 100° C. to melt the wax. The mixture is subjected to an emulsification treatment with a homogenizer (ULTRA-TURRAX® from IKA) for 15 minutes and another emulsification treatment with a GAULIN HOMOGENIZER at 100° C. Thus, a release agent particle dispersion (R1) containing 21.5% of release agent particles having a median diameter of 230 nm and a melting point of 83° C. is prepared.

Preparation of Toner (1): A toner (1) is prepared as follows. First, 168 parts of the resin particle dispersion (1) (including 42 parts of the resin), 40 parts of the colorant particle dispersion (C1) (including 8.6 parts of the colorant), 80 parts of the release agent particle dispersion (R1) (including 17.2 parts of the release agent), 0.15 parts of polyaluminum chloride, and 300 parts of ion-exchange water are subjected to mixing and dispersion treatments with a homogenizer (ULTRA-TURRAX® from IKA) in a round-bottom stainless-steel flask. The flask is put in an oil bath and the mixture is heated to 42° C. while being agitated. The mixture is kept at 42° C. for 60 minutes. Thereafter, 84 parts of the resin particle dispersion (1) (including 21 parts of the resin) are added to the flask and the mixture is mildly agitated. After termination of the agitation, a 0.5 mol/l sodium hydroxide aqueous solution is added to the flask so that pH of the reaction system gets 6.0. The mixture is further heated to 95° C. while being agitated.

While being heated to 95° C., the mixture is additionally supplied with the sodium hydroxide aqueous solution so that the pH of the reaction system does not fall below 5.5. The mixture is kept at 95° C. for 3 hours After termination of the reaction, the reaction system was cooled, filtered, washed with water, and suction-filtered with a Nutsche. Thus, solid components and liquid components are separated. The solid components are redispersed in ion-exchange water at 40° C. and agitated at a revolution of 300 rpm for 15 minutes to be washed. After repeating this washing operation 5 times, solid components and liquid components are separated by suction filtration with a Nutsche. The solid components are vacuum-dried for 12 hours. Thus, cyan toner particles (1) are prepared. The cyan toner particles (1) have a volume average particle diameter of 5.8 μm measured by a COULTER COUNTER.

Preparation of Developer (1): A cyan developer (1) is prepared as follows. A cyan toner (1) is prepared by mixing 50 parts of the cyan toner particles (1) and 1.5 parts of hydrophobized silica particles (TS720 from Cabot Corporation) with a sample mill. A covering layer forming liquid is prepared by subjecting 100 parts of a silicone resin solution (KR50 from Shin-Etsu Chemical Co., Ltd.), 3 parts of a carbon black (BP2000 from Cabot Corporation), and 100 parts of toluene to a dispersion treatment with a homomixer for 30 minutes. The covering layer forming liquid is applied to the surfaces of 1,000 parts of spherical ferrite carrier particles having an average particle diameter of 50 μm by a fluidized-bed application device. Thus, a carrier is prepared. A cyan developer (1) is prepared by mixing 90 parts of the cyan toner (1) with 910 parts of the carrier with a ball mill for 30 minutes.

The procedure for preparing the cyan developer (1) is repeated except for replacing the cyan pigment with each of a magenta pigment (C.I. Pigment Red 57:2), a yellow pigment (C.I. Pigment Yellow 97), and a black pigment (carbon black R330). Thus, a magenta developer (1), a yellow developer (1), and a black developer (1) are prepared.

Preparation of Resin Particle Dispersion (2): A resin particle dispersion (2) containing polyester resin particles is prepared as follows. First, 175 parts of 1,4-cyclohexanedicarboxylic acid, 320 parts of ethylene oxide 2 mol adduct of bisphenol A, and 0.5 parts of dodecylbenzenesulfonic acid are mixed. The mixture is poured in a reactor equipped with a stirrer and subjected to a polycondensation for 12 hours at 120° C. under nitrogen atmosphere. Thus, a polyester resin (1) is prepared. The polyester resin (1) is uniformly transparent. The polyester resin (1) has a weight average molecular weight (Mw) of 14,000 measured by GPC and a glass transition temperature (Tg) of 54° C. measured by DSC.

On the other hand, 0.36 parts of dodecylbenzenesulfonic acid, 80 parts of 1,6-hexanediol, and 115 parts of sebacic acid are mixed and the mixture is poured in a reactor equipped with a stirrer. The mixture is subjected to a polycondensation for 5 hours at 90° C. under nitrogen atmosphere. Thus, a polyester resin (2) is prepared. The polyester resin (2) is uniformly white. The polyester resin (2) has a weight average molecular weight (Mw) of 8,000 measured by GPC and a glass transition temperature (Tg) of −52° C. measured by DSC.

Next, 100 parts of the polyester resin (1) and 100 parts of the polyester resin (2) are melt and mixed for 30 minutes at 120° C. in a reactor equipped with a stirrer. A neutralization solution, in which 1.0 parts of sodium dodecylbenzenesulfonate and 1.0 parts of 1N NaOH aqueous solution are dissolved in 800 parts of ion-exchange water having a temperature of 95° C., is poured in a flask. The mixture is emulsified in the solution in the flask with a homogenizer (ULTRA-TURRAX® from IKA) for 5 minutes. The flask is shaken in an ultrasonic bath for 10 minutes and cooled with room-temperature water. Thus, a resin particle dispersion (2) containing 20% by weight of resin particles having a median particle diameter of 250 nm is prepared.

Preparation of Toner (2): A toner (2) is prepared as follows. First, 210 parts of the resin particle dispersion (2) (including 42 parts of the resin), 40 parts of the colorant particle dispersion (C1) (including 8.6 parts of the colorant), 40 parts of the release agent particle dispersion (R1) (including 8.6 parts of the release agent), 0.15 parts of polyaluminum chloride, and 300 parts of ion-exchange water are subjected to mixing and dispersion treatments with a homogenizer (ULTRA-TURRAX® from IKA) in a round-bottom stainless-steel flask. The flask is put in an oil bath and the mixture is heated to 42° C. while being agitated. The mixture is kept at 42° C. for 42 minutes. Thereafter, 105 parts of the resin particle dispersion (2) (including 21 parts of the resin) are added to the flask and the mixture is mildly agitated.

After termination of the agitation, a 0.5 mol/l sodium hydroxide aqueous solution is added to the flask so that pH of the reaction system gets 6.0. The mixture is further heated to 95° C. while being agitated. While being heated to 95° C., the mixture is additionally supplied with the sodium hydroxide aqueous solution so that the pH of the reaction system does not fall below 5.0. The mixture is kept at 95° C. for 3 hours. After termination of the reaction, the reaction system was cooled, filtered, washed with water, and suction-filtered with a Nutsche. Thus, solid components and liquid components are separated. The solid components are redispersed in 3 liters of ion-exchange water at 40° C. and agitated at a revolution of 300 rpm for 15 minutes to be washed. After repeating this washing operation 5 times, solid components and liquid components are separated by suction filtration with a Nutsche. The solid components are vacuum-dried for 12 hours. Thus, cyan toner particles (2) are prepared. The cyan toner particles (2) have a volume average particle diameter of 4.9 μm measured by a COULTER COUNTER.

Preparation of Developer (2): A cyan developer (2) is prepared as follows. A cyan toner (2) is prepared by mixing 50 parts of the cyan toner particles (2) and 1.5 parts of hydrophobized silica particles (TS720 from Cabot Corporation) with a sample mill. A covering layer forming liquid is prepared by subjecting 100 parts of a silicone resin solution (KR50 from Shin-Etsu Chemical Co., Ltd.), 3 parts of a carbon black (BP2000 from Cabot Corporation), and 100 parts of toluene to a dispersion treatment with a homomixer for 30 minutes. The covering layer forming liquid is applied to the surfaces of 1,000 parts of spherical ferrite carrier particles having an average particle diameter of 50 μm by a fluidized-bed application device. Thus, a carrier is prepared. A cyan developer (2) is prepared by mixing 90 parts of the cyan toner (2) with 910 parts of the carrier with a ball mill for 30 minutes.

The procedure for preparing the cyan developer (2) is repeated except for replacing the cyan pigment with each of a magenta pigment (C.I. Pigment Red 57:2), a yellow pigment (C.I. Pigment Yellow 97), and a black pigment (carbon black R330). Thus, a magenta developer (2), a yellow developer (2), and a black developer (2) are prepared.

Example 1

Figure 6:
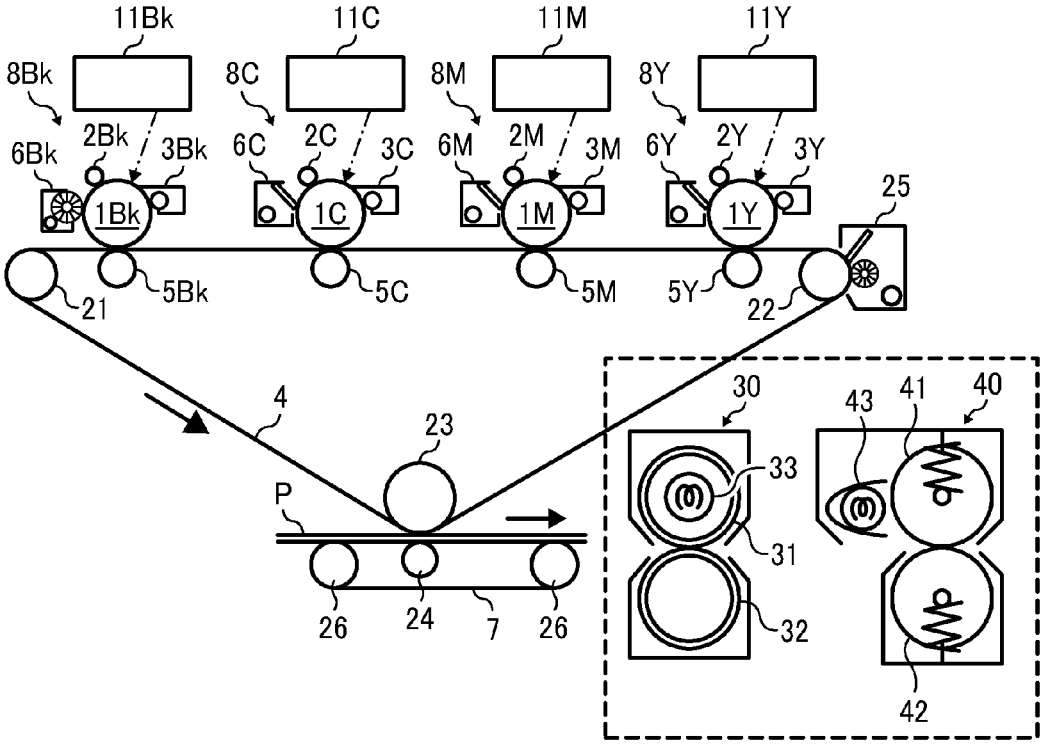
FIG. 6 is a schematic view of an image forming apparatus according to an embodiment.
Figure 7A:
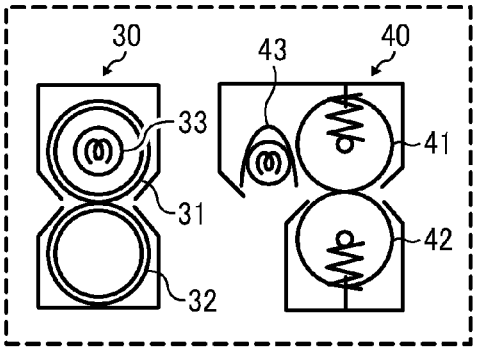
FIGS. 7A to 7D are schematic views of fixing units according to some embodiments.
Figure 7B:
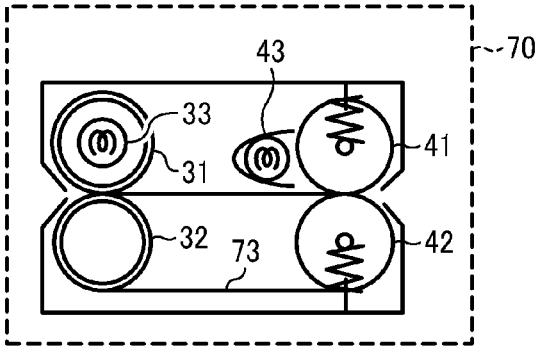
Figure 7C:
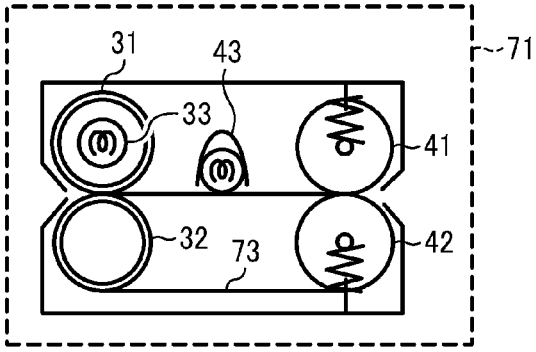
Figure 7D:
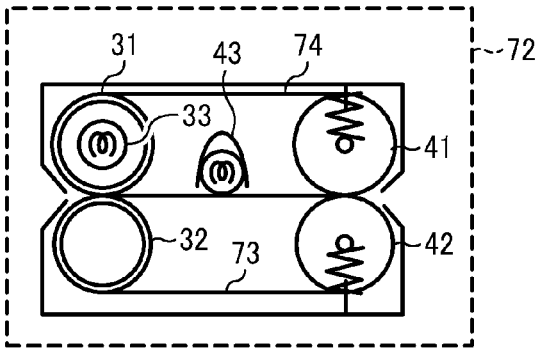
Figure 8A:
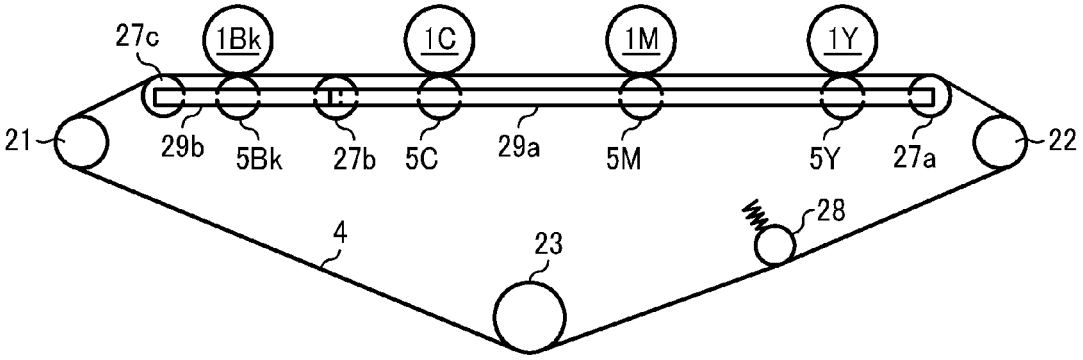
FIGS. 8A to 8C are schematic views of moving devices according to some embodiments.
Figure 8B:
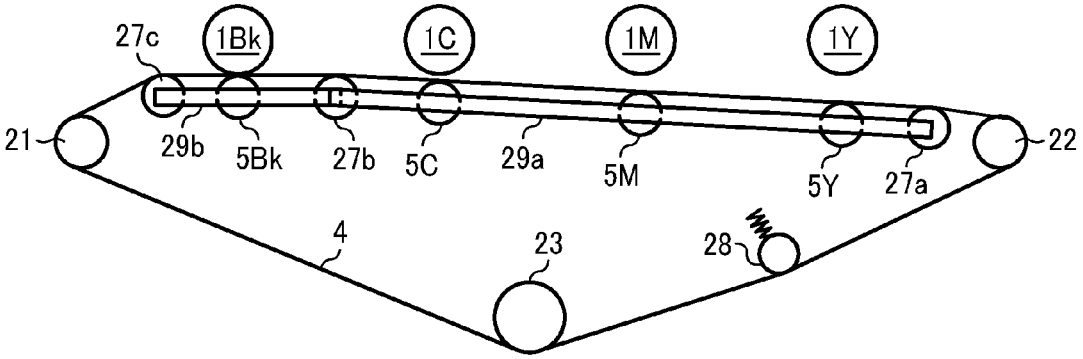
Figure 8C:
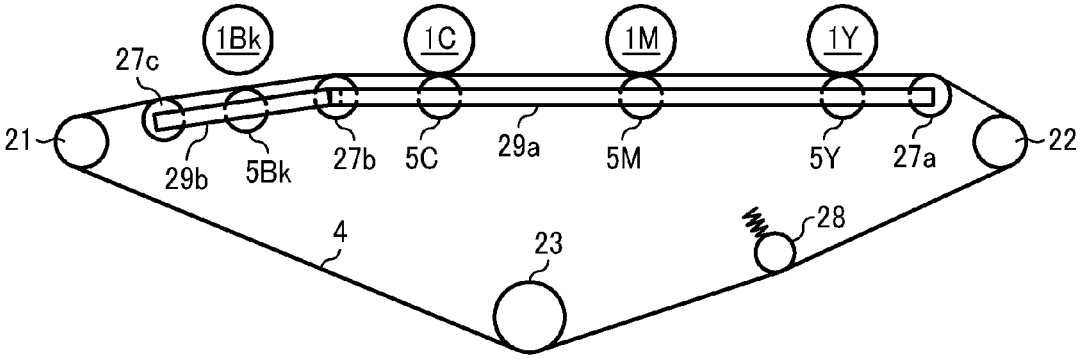
Figure 9:
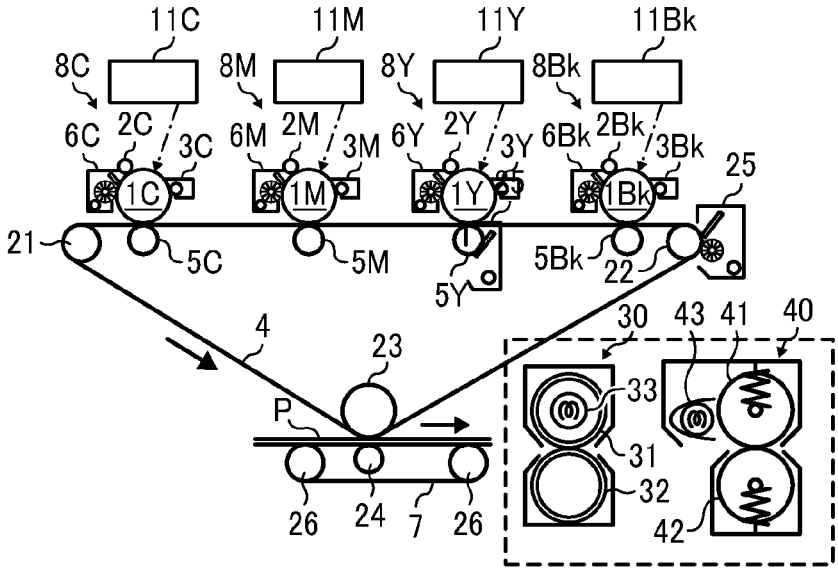
FIGS. 9 to 13 are schematic views of image forming apparatuses according to some embodiments.
Figure 10:
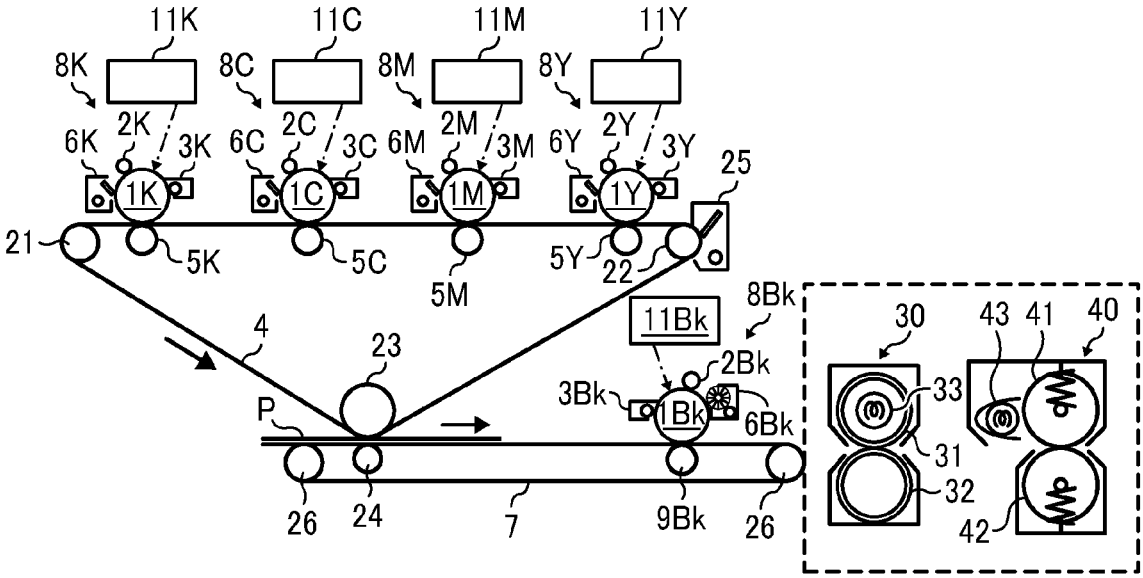
Figure 11:
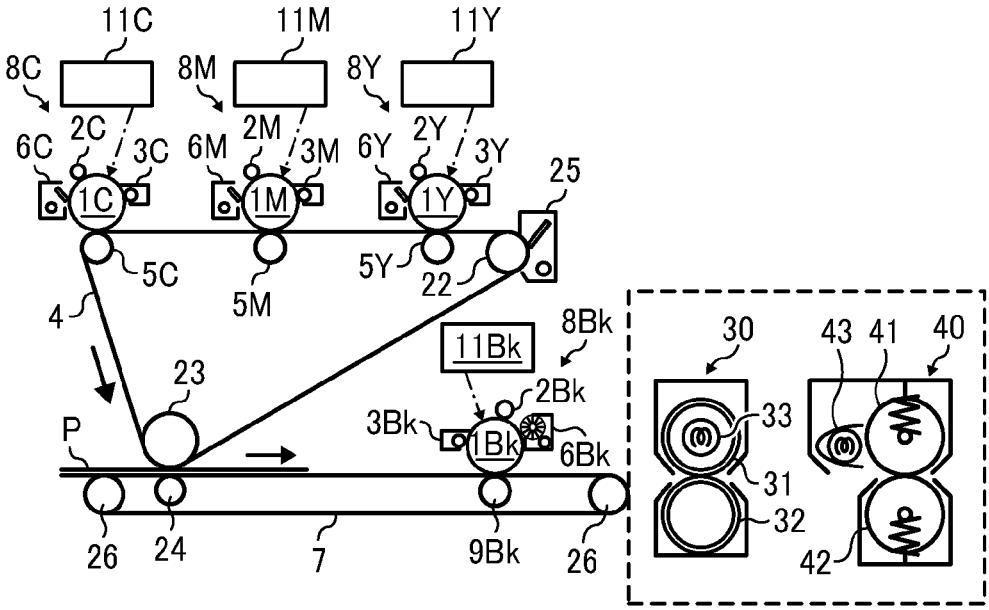
Figure 12:
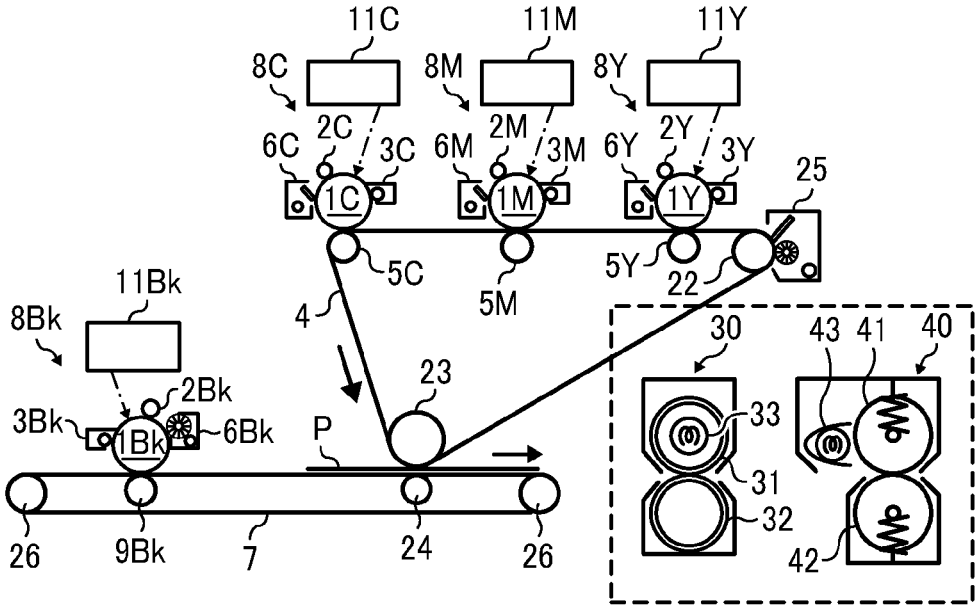
Figure 13:
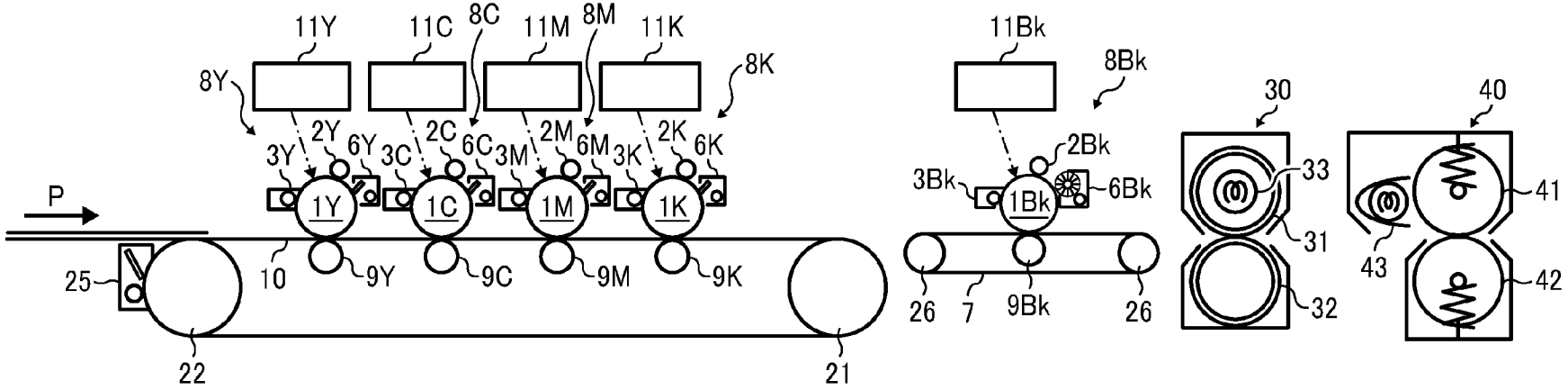

FIG. 6 is a schematic view of an image forming apparatus according to an embodiment (Example 1-1). FIGS. 7A to 7D are schematic views of fixing units according to some embodiments. FIGS. 8A to 8C are schematic views of moving devices according to some embodiments. FIG. 9 is a schematic view of an image forming apparatus according to another embodiment (Example 1-2). FIG. 10 is a schematic view of an image forming apparatus according to another embodiment (Example 1-3). FIG. 11 is a schematic view of an image forming apparatus according to another embodiment (Example 1-4). FIG. 12 is a schematic view of an image forming apparatus according to another embodiment (Example 1-5). FIG. 13 is a schematic view of an image forming apparatus according to another embodiment (Example 1-6).

In these embodiments, a black toner for forming black-and-white images employs the pressure-induced phase transition resin toner, and the heat fixing device 30 having the heat fixing nip and the pressure fixing device 40 having the pressure fixing nip are provided on upstream and downstream sides, respectively, relative to the direction of conveyance of the recording medium P. The dual fixing nips, including the heat fixing nip for fixing the thermoplastic resin toner and the pressure fixing nip for fixing the pressure-induced phase transition resin toner, provides the following advantages (A) to (F).

(A) Energy Conservation: Because the pressure-induced phase transition resin toner is employed as a black toner for forming black-and-white images, which is most frequently used, energy conservation is improved.

(B) Stable Fixing Property: Because the heat fixing nip for fixing the thermoplastic resin toner on the recording medium P by application of heat and the pressure fixing nip for fixing the pressure-induced phase transition resin toner on the recording medium P by application of pressure are independently provided, a difference in toner pile height in the pressure fixing nip is relatively small. Therefore, the pressure-induced phase transition resin toner is applied with more uniform pressure in the pressure fixing nip. There is no need to provide respective fixing devices to each imaging unit or a special fixing device which applies a high pressure. Thus, advantageously, the image forming apparatus does not get either larger or heavier (i.e., get oversized).

(C) Color Reproducibility: Because the pressure-induced phase transition resin toner is prevented from being applied with non-uniform pressure in the pressure fixing nip, the pressure-induced phase transition resin toner sufficiently fluidizes without aggregating when being fixed on a recording medium and the resulting image has neither toner grain aggregate nor void. Thus, image density decrease does not occur in a black-and-white image that is formed from only the pressure-induced phase transition resin toner that is not applied with non-uniform pressure. Even in a full-color image, neither fixing strength between toner and the recording medium P nor color reproducibility deteriorate. Because the resulting image has neither toner grain aggregate nor void, the surface thereof is so smooth that the image exhibits proper gloss.

(D) Avoidance of Oversized Pressure Fixing Device: Because only one kind of pressure-induced phase transition resin toner (i.e., black toner) is employed, the pressure fixing device need not provide a large pressure, thereby preventing the pressure fixing device from getting larger or heavier (i.e., getting oversized).

(E) Reduction of Noise and Prevention of Speed Fluctuation Transmission: The recording medium P first passes through the heat fixing nip in the heat fixing device 30 and subsequently passed though the pressure fixing nip in the pressure fixing device 40. Because a toner image on the recording medium P has passed through the heat fixing nip before entering into the pressure fixing nip, the toner pile height is relatively small in the pressure fixing nip. Therefore, especially when the recording medium P is relatively thick, noise made upon entry of the recording medium P into a fixing nip is reduced. Additionally, speed fluctuation, caused upon entry of the recording medium P into a fixing nip, is prevented from being transmitted to the photoreceptors 1 or the intermediate transfer medium 4.

(F) Cleanability: Among the multiple imaging units, only the imaging unit 8Bk employs the pressure-induced phase transition resin toner for forming black images. Compared to a case in which all the imaging units employ the pressure-induced phase transition resin toners, the amount of the pressure-induced phase transition resin toner to be removed by the photoreceptor cleaner 6Bk in the imaging unit 8Bk is smaller. Therefore, the pressure-induced phase transition resin toner can be removed from the photoreceptor only with a brush cleaner without an excessive pressure. Thus, cleanability of the pressure-induced phase transition resin toner is improved.

In a case in which the image forming apparatus is configured such that the thermoplastic resin toner is prevented from being retransferred onto the photoreceptor 1Bk, cleanability of the pressure-induced phase transition resin toner from the photoreceptor 1Bk and intermediate transfer medium 4 is more improved.

Example 1-1

The image forming apparatus of Example 1-1, illustrated in FIG. 6, has the same configuration as that illustrated in FIG. 4.

Referring to FIG. 6, the imaging units 8Y, 8M, and 8C are disposed along an upper surface of the intermediate transfer medium 4 in this order from an upstream side thereof relative to the direction of movement of the intermediate transfer medium 4. The imaging units 8Y, 8M, and 8C contain thermoplastic resin toners for forming images of yellow, magenta, and cyan, respectively. The imaging unit 8Bk containing a pressure-induced phase transition resin toner for forming black image is disposed at the most downstream side relative to the direction of movement of the intermediate transfer medium 4. The photoreceptor cleaners 6Y, 6M, and 6C are disposed around the photoreceptors 1Y, 1M, and 1C, respectively. The photoreceptor cleaners 6Y, 6M, and 6C are adapted to remove residual thermoplastic resin toner particles from the photoreceptors 1Y, 1M, and 1C, respectively, with a cleaning blade. The photoreceptor cleaner 6Bk disposed around the photoreceptor 1Bk is adapted to remove residual toner particles from the photoreceptor 1Bk with a cleaning brush without applying mechanical stress thereto.

The belt cleaner 25 is disposed facing the driven roller 22 with the intermediate transfer medium 4 therebetween. The belt cleaner 25 includes a cleaning brush on an upstream side and a cleaning blade on a down stream side relative to the direction of movement of the intermediate transfer medium 4. In the belt cleaner 25, the cleaning brush removes the pressure-induced phase transition resin toner without applying mechanical stress thereto and the cleaning blade removes the thermoplastic resin toner. In the present embodiment, cleanability of the pressure-induced phase transition resin toner from the photoreceptor 1Bk and intermediate transfer medium 4 is more improved (the above-described advantage (F)).

In the present embodiment, the fixing unit, shown by dotted lines in FIG. 6, includes the heat fixing device 30 adapted to fix the thermoplastic resin toner on the recording medium P and the pressure fixing device 40 adapted to fix the pressure-induced phase transition resin toner on the recording medium P. These fixing devices are independently replaceable depending on their independent lifespan. FIG. 7A is a schematic view of the fixing unit according to another embodiment. In the embodiment illustrated in FIG. 7A, the halogen heater 43, serving as an auxiliary heat source, is adapted to heat the pressure-induced phase transition resin toner on the recording medium P rather than the metallic pressing roller 41. FIGS. 7B to 7D are schematic views of the fixing unit according to other embodiments. In these embodiments, the heat and pressure fixing devices are integrated. The halogen heater 43 is an auxiliary heat source which consumes less electric power than the halogen heater 33 included in the heat fixing device 30.

In a fixing device 70 illustrated in FIG. 7B, a recording medium conveying belt 73 is stretched taut between the pressing rollers 32 and 42 used for fixing the thermoplastic resin toner and the pressure-induced phase transition resin toner, respectively. The recording medium conveying belt 73 stabilizes the behavior of the recording medium P between the heat and pressure fixing nips. A fixing device 71 illustrated in FIG. 7C has a similar configuration to the fixing device 70 except that the halogen heater 43 is adapted to heat the pressure-induced phase transition resin toner on the recording medium P rather than the pressing roller 41. A fixing device 72 illustrated in FIG. 7D has a similar configuration to the fixing device 71 except that a fixing belt 74 is stretched taut between the fixing roller 31 used for fixing the thermoplastic resin toner and the pressing roller 41 used for fixing the pressure-induced phase transition resin toner. The halogen heater 43 is adapted to heat the fixing belt 74.

In the present embodiment, two printing modes, i.e., a black-and-white mode and a color mode, are available. In the black-and-white mode, only the black pressure-induced phase transition resin toner is used. In the color mode, only the thermoplastic resin toners of yellow, magenta, and cyan are used. In the black-and-white mode, a black toner image is formed on the photoreceptor 1Bk with the black pressure-induced phase transition resin toner. The photoreceptors 1Y, 1M, and 1C are drawn away from the intermediate transfer medium 4 by a moving device. Thus, the thermoplastic resin toners of yellow, magenta, and cyan are prevented from being retransferred onto the photoreceptor 1Bk. Residual toner particles remaining on the photoreceptor 1Bk without being primarily transferred onto the intermediate transfer medium 4 include the black pressure-induced phase transition resin toner particles only. Thus, the photoreceptor cleaner 6Bk can clean the photoreceptor 1Bk with great efficiency.

Similarly, residual toner particles remaining on the intermediate transfer medium 4 without being secondarily transferred onto the recording medium P include the black pressure-induced phase transition resin toner particles only. Thus, the cleaning brush in the belt cleaner 25 can clean the intermediate transfer medium 4 with great efficiency.

Unnecessary operations of the imaging units 8Y, 8M, and 8C are avoided so as to improve their lifespans. Similarly, unnecessary operation of the heat fixing device 30 is avoided by separating the fixing roller 31 and the pressing roller 32 from each other by a moving device so as to improve the lifespan of the heat fixing device 30. The black pressure-induced phase transition resin toner is transferred from the intermediate transfer medium 4 onto the recording medium P and fixed thereon by the halogen heater 43 and the pressure fixing device 40. In the black-and-white mode, the heat fixing device 30 may function as an auxiliary heat source that preliminarily heats the pressure-induced phase transition resin toner.

In the color mode, a color toner image is formed with the thermoplastic resin toners of yellow, magenta, and cyan only while the photoreceptor 1Bk is drawn away from the intermediate transfer medium 4 by a moving device. Thus, the thermoplastic resin toners of yellow, magenta, and cyan are prevented from retransferred onto the photoreceptor 1Bk via the intermediate transfer medium 4 and the photoreceptor 1Bk can be effectively cleaned.

Residual toner particles remaining on the intermediate transfer medium 4 without being secondarily transferred onto the recording medium P include the thermoplastic resin toner particles of yellow, magenta, and cyan only. Thus, the cleaning blade in the belt cleaner 25 can clean the intermediate transfer medium 4 with great efficiency.

In the pressure fixing device 40, the pressing rollers 41 and 42 are separated from each other by a moving device. Thus, unnecessary operation of the pressure fixing device 40, deterioration of color image formed with the thermoplastic resin toners, and noise generation are avoided.

The moving device for separating the photoreceptor 1Bk or the photoreceptors 1Y, 1M, and 1C from the intermediate transfer medium 4 may be disposed on either the side of the imaging units 8 or the side of the intermediate transfer medium 4. In the former case, each of the imaging units 8Y, 8M, 8C, and 8Bk may include independent moving device. Alternatively, the moving device may move the imaging units 8Y, 8M, and 8C used in the color mode independently from the imaging unit 8Bk used in the black-and-white mode.

FIG. 8A is a schematic view of the moving device according to an embodiment. In the embodiment illustrated in FIG. 8A, the moving device is disposed on the side of the intermediate transfer medium 4. The moving device includes a tension roller 27*a* disposed between the photoreceptor 1Y and the driven roller 22, a tension roller 27*b* disposed between the photoreceptor 1C and the photoreceptor 1Bk, and a tension roller 27*c* disposed between the photoreceptor 1Bk and the driving roller 21. The moving device further includes a tension roller 28 disposed between the driven roller 22 and the secondary transfer facing roller 23. The moving device further includes a frame 29*a* rotatable about the rotation center of the tension roller 27*b*. The frame 29*a* supports the primary transfer rollers 5Y, 5M, and 5C and the tension roller 27*a*. The moving device further includes a frame 29*b* rotatable about the rotation center of the tension roller 27*b*. The frame 29*b* supports the primary transfer roller 5Bk and the tension roller 27*c*. When the frames 29*a* and 29*b* are horizontally aligned, each of the tension rollers 27*a*, 27*b*, and 27C and primary transfer rollers 5Y, 5M, 5C, and 5Bk contacts the intermediate transfer medium 4 at substantially the same height while each of the primary transfer rollers 5Y, 5M, 5C, and 5Bk is positioned in each primary transfer position.

To separate the photoreceptors 1Y, 1M, and 1C from the intermediate transfer medium 4, as illustrated in FIG. 8B, the tension-roller-27*a*-side of the frame 29*a* is rotated downward about the rotation center of the tension roller 27*b* by a rotary device. To separate the photoreceptor 1Bk from the intermediate transfer medium 4, as illustrated in FIG. 8C, the tension-roller-27*c*-side of the frame 29*b* is rotated downward about the rotation center of the tension roller 27*b* by a rotary device. The driven roller 22 and the driving roller 21 are positioned so that the tension rollers 27*a*, 27*b*, 27C, and 28 are never separated from the intermediate transfer medium 4 even when the photoreceptors 1Y, 1M, and 1C or the photoreceptor 1Bk are/is separated from the intermediate transfer medium 4 by rotation of the frame 29*a* or 29*b*. It is much simpler and cheaper to provide the moving device on the side of the intermediate transfer medium 4 rather than the side of the imaging units 8.

In the present embodiment, the above-described advantage (F), i.e., improvement in cleanability of the pressure-induced phase transition resin toner, is provided as well as the advantages (A) to (E). In the present embodiment, the number of imaging units 8 is four, which is general and smaller than that in the later-described Examples 1-3 and 1-6.

Example 1-2

Example 1-2 is different from Example 1-1 in that the imaging unit 8Bk containing the black pressure-induced phase transition resin toner is brought into operation even in the color mode.

Referring to FIG. 9, the imaging unit 8Bk containing the black pressure-induced phase transition resin toner is disposed at the most upstream side of an upper surface of the intermediate transfer medium 4 relative to the direction of movement of the intermediate transfer medium 4. The imaging units 8Y, 8M, and 8C containing the thermoplastic resin toners of yellow, magenta, and cyan, respectively, are disposed along the upper surface of the intermediate transfer medium 4 in this order at a downstream side from the imaging unit 8Bk relative to the direction of movement of the intermediate transfer medium 4. Thus, the thermoplastic resin toners of yellow, magenta, and cyan transferred from the respective photoreceptors 1Y, 1M, and 1C onto the intermediate transfer medium 4 are prevented from being retransferred onto the photoreceptor 1Bk disposed at the most upstream side. In this embodiment, the photoreceptor 1Bk can be cleaned with great efficiency without separating the photoreceptor 1Bk from the intermediate transfer medium 4 in the color mode.

As described above, the photoreceptor cleaner 6Bk includes a cleaning blade and a cleaning brush. Similarly, each of the photoreceptor cleaners 6Y, 6M, and 6C includes a cleaning blade and a cleaning brush disposed upstream from the cleaning blade relative to the direction of rotation of the photoreceptors 1Y, 1M, and 1C, respectively. Thus, the photoreceptors 1Y, 1M, and 1C can be cleaned with great efficiency even in a case in which the black pressure-induced phase transition resin toner transferred from the photoreceptor 1Bk onto the intermediate transfer medium 4 are retransferred onto the photoreceptors 1Y, 1M, and 1C. In each of the photoreceptor cleaners 6Y, 6M, and 6C, the black pressure-induced phase transition resin toner retransferred onto the photoreceptors 1Y, 1M, and 1C are removed with the cleaning brush and subsequently each thermoplastic resin toner is removed by the cleaning blade.

As described above, the belt cleaner 25 includes a cleaning brush on an upstream side and a cleaning blade on a down stream side relative to the direction of movement of the intermediate transfer medium 4. In the belt cleaner 25, the cleaning brush removes residual black pressure-induced phase transition resin toner particles remaining on the intermediate transfer medium 4 without applying mechanical stress thereto. The cleaning blade removes residual thermoplastic resin toner particles of yellow, magenta, and cyan remaining on the intermediate transfer medium 4. Thus, the intermediate transfer medium 4 can be cleaned with great efficiency.

In the color mode, the black pressure-induced phase transition resin toner and the thermoplastic resin toners of yellow, magenta, and cyan are sequentially transferred onto the intermediate transfer medium 4 and further transferred onto the recording medium P. The recording medium P having the above toners thereon then passes through the heat fixing device 30 and the pressure fixing device 40. This means that the unfixed black pressure-induced phase transition resin toner passes through the heat fixing nip in the heat fixing device 30. In the heat fixing device 30, the thermoplastic resin toners of yellow, magenta, and cyan are fixed on the recording medium P under a high temperature and a low pressure while the layer thereof is smoothened and the pile height thereof is reduced. Thereafter, in the pressure fixing device 40, the black pressure-induced phase transition resin toner is fixed on the recording medium P under a low temperature and a high pressure.

In the heat fixing device 30, the black pressure-induced phase transition resin toner is applied with too small a pressure to be fluidized and fixed on the recording medium P with pressure. The black pressure-induced phase transition resin toner fluidizes only slightly (i.e., merely softens) in the heat fixing device 30. The black pressure-induced phase transition resin toner need not be completely fixed on the recording medium P in the heat fixing nip in the heat fixing device 30, however, is required not to be retransferred onto the fixing roller 31 (this phenomenon is hereinafter referred to as "hot offset"). Therefore, the thermoplastic resin toners of yellow, magenta, and cyan are required to be fixed on the recording medium P in the heat fixing nip in the heat fixing device 30 under pressure and temperature conditions in which the black pressure-induced phase transition resin toner does not cause hot offset. In a case in which the thermoplastic resin toners of yellow, magenta, and cyan are forced to be fixed on the recording medium P in the heat fixing nip in the heat fixing device 30 under pressure and temperature conditions in which the black pressure-induced phase transition resin toner does cause hot offset, a toner image may be formed only with the thermoplastic resin toners of yellow, magenta, and cyan without the black pressure-induced phase transition resin toner.

The present embodiment provides the same advantageous effects as Example 1-1 while consuming a smaller amount of the thermoplastic resin toners than Example 1-1 and the later-described Example 1-4 in which a black image is formed with three thermoplastic resin toners of yellow, magenta, and cyan.

Example 1-3

Example 1-3 is different from Example 1-1 in that the image forming apparatus includes primary transfer devices for transferring thermoplastic resin toner images of yellow, magenta, cyan, and black from photoreceptors 1Y, 1M, 1C, and 1K, respectively, onto the intermediate transfer medium 4 to form a composite toner image thereon and a secondary transfer device for transferring the composite toner image from the intermediate transfer medium 4 onto the recording medium P, and further includes a direct transfer device for directly transferring a black pressure-induced phase transition resin toner image from the photoreceptor 1Bk onto the recording medium P. The imaging unit 8Bk containing the black pressure-induced phase transition resin toner is disposed facing the recording medium conveying belt 7 at a downstream side from the secondary transfer nip, at which the composite toner image is transferred from the intermediate transfer medium 4 onto the recording medium P, relative to the direction of conveyance of the recording medium P. In the color mode, only the imaging units 8Y, 8M, 8C, and 8K are brought into operation. In the black-and-white mode, only the imaging unit 8Bk is brought into operation.

Referring to FIG. 10, the imaging unit 8Bk containing the black pressure-induced phase transition resin toner is disposed independently from the imaging units 8Y, 8M, 8C, and 8K containing the thermoplastic resin toners of yellow, magenta, cyan, and black, respectively. The imaging unit 8K containing the black thermoplastic resin toner is tandemly arranged with the imaging units 8Y, 8M, and 8C containing the thermoplastic resin toners of yellow, magenta, and cyan, respectively, at a downstream side thereof relative to the direction of movement of the intermediate transfer medium 4. Example 1-3 illustrated in FIG. 10 is different from Example 1-1 illustrated in FIG. 6 in that the imaging unit 8Bk is replaced with the imaging unit 8K and the imaging unit 8Bk is independently disposed facing the recording medium conveying belt 7 at a downstream side from the secondary transfer nip.

Thermoplastic resin toner images of yellow, magenta, cyan, and black formed on the photoreceptors 1Y, 1M, 1C, and 1K, respectively, are sequentially transferred onto the intermediate transfer medium 4 by the primary transfer rollers 5Y, 5M, 5C, and 5K, respectively, to form a composite toner image thereon. The primary transfer rollers 5Y, 5M, 5C, and 5K are disposed facing the photoreceptors 1Y, 1M, 1C, and 1K, respectively, with the intermediate transfer medium 4 therebetween, thus forming primary transfer nips. The composite toner image is transferred from the intermediate transfer medium 4 onto the recording medium P, conveyed by the recording medium conveying belt 7, by a secondary transfer device. The secondary device includes the secondary transfer facing roller 23 and the secondary transfer roller 24. The secondary transfer facing roller 23 and the secondary transfer roller 24 are disposed facing each other with the intermediate transfer medium 4 and the recording medium conveying belt 7 therebetween, thus forming a secondary transfer nip. The image forming apparatus further includes a direct transfer device for directly transferring a black pressure-induced phase transition resin toner image from the photoreceptor 1Bk onto the recording medium P conveyed by the recording medium conveying belt 7. The direct transfer device includes a primary transfer roller 9Bk. The primary transfer roller 9Bk is disposed facing the photoreceptor 1Bk with the recording medium conveying belt 7 therebetween, thus forming a direct transfer nip.

The secondary transfer nip in which the thermoplastic resin toner image is transferred onto the recording medium P and the direct transfer nip in which the black pressure-induced phase transition resin toner image is transferred onto the recording medium P are independently provided. The black pressure-induced phase transition resin toner image is directly transferred from the photoreceptor 1Bk onto the recording medium P on the recording medium conveying belt 7.

Similar to the photoreceptor cleaners 6Y, 6M, and 6C, a photoreceptor cleaner 6K includes a cleaning blade. In the present embodiment, the belt cleaner 25 includes a cleaning blade but does not include a cleaning brush, which is different from Examples 1-1 and 1-2 and the later-described Example 1-5. In the black-and-white mode, only the black pressure-induced phase transition resin toner is used. In the color mode, only the thermoplastic resin toners of yellow, magenta, cyan, and black are used.

In the black-and-white mode, a black toner image is formed with the imaging unit 8Bk only while the intermediate transfer medium 4 is drawn away from the recording medium conveying belt 7 by a moving device. Therefore, the thermoplastic resin toners of yellow, magenta, cyan, and black are prevented from being retransferred onto the photoreceptor 1Bk. Thus, in the same manner as Example 1-1, the photoreceptor cleaner 6Bk can clean the photoreceptor 1Bk with great efficiency.

Because the black pressure-induced phase transition resin toner is not likely to migrate to the intermediate transfer medium 4, the belt cleaner 25 does not need a cleaning brush.

The moving device for separating the intermediate transfer medium 4 from the recording medium conveying belt 7 may have a mechanism of moving the secondary transfer facing roller 23 upward. In this case, in the same manner as Example 1-1, the tension roller 28 is provided so that the intermediate transfer medium 4 is stretched even when the secondary transfer facing roller 23 is moved upward. In the heat fixing device 30, the fixing roller 31 and the pressing roller 32 are separated from each other by a cam member, etc.

In the black-and-white mode, unnecessary operations of the imaging units 8Y, 8M, 8C, and 8K and the intermediate transfer medium 4 are avoided so as to improve their lifespans.

In the color mode, a color toner image is formed on the intermediate transfer medium 4 with the imaging units 8Y, 8M, 8C, and 8K only while the photoreceptor 1Bk is drawn away from the recording medium conveying belt 7 by a moving device. Thus, the thermoplastic resin toners of yellow, magenta, cyan, and black are prevented from retransferred onto the photoreceptor 1Bk via the intermediate transfer medium 4 and the recording medium P, and the photoreceptor 1Bk can be effectively cleaned.

Residual toner particles remaining on the intermediate transfer medium 4 without being secondarily transferred onto the recording medium P include the thermoplastic resin toner particles of yellow, magenta, cyan, and black only. Thus, the cleaning blade in the belt cleaner 25 can clean the intermediate transfer medium 4 with great efficiency.

The moving device for separating the photoreceptor 1Bk from the recording medium conveying belt 7 may have a mechanism of moving the imaging unit 8Bk including the photoreceptor 1Bk upward. Alternatively, the moving device may be contained in the imaging unit 8Bk. In the pressure fixing device 40, the pressing rollers 41 and 42 are separated from each other by a cam member, etc. In the color mode, a black toner image is formed with the black thermoplastic resin toner. Therefore, consumption of the thermoplastic resin toners of yellow, magenta, and cyan is reduced. Because a black toner image is formed with the black thermoplastic resin toner, the black pressure-induced phase transition resin toner never passes through the heat fixing nip in the heat fixing device 30. Therefore, fixing conditions in the heat fixing device 30 can be determined without taking into consideration the thermal characteristics of the black pressure-induced phase transition resin toner.

Similar to Example 1-1, in the present embodiment using both the pressure-induced phase transition resin toner and the thermoplastic resin toner, the above-described advantage (F), i.e., improvement in cleanability of the pressure-induced phase transition resin toner, is provided as well as the advantages (A) to (E). Even though the number of imaging units is greater than Examples 1-1 and 1-2 and the later-described Examples 1-4 and 1-5, the present embodiment has an advantage that switching between the black-and-white mode and the color mode is much easier. Namely, in the switching operation, the intermediate transfer medium 4 or the imaging unit 8Bk is moved away from or toward the recording medium conveying belt 7 rather than the photoreceptors 1Y, 1M, 1C, and 1K are moved away from or toward the intermediate transfer medium 4. Thus, the moving device gets much simpler than that in Examples 1-1 and 1-2. In the black-and-white mode, the intermediate transfer medium 4 is drawn away from the recording medium conveying belt 7, thus more improving the lifespan of the intermediate transfer medium 4 than in Embodiments 1 and 2. Similar to Example 1-2, the consumed amount of the thermoplastic resin toners is smaller than in Example 1-1 and the later-described Example 1-4 in which a black toner image is formed with three thermoplastic resin toners of yellow, magenta, and cyan. Similar to Examples 1-1 and 1-2, because the black pressure-induced phase transition resin toner is not likely to migrate to the intermediate transfer medium 4, the belt cleaner 25 does not need a cleaning brush for removing the black pressure-induced phase transition resin toner.

Example 1-4

Example 1-4 is different from Example 1-3 in that the imaging units 8Y, 8M, and 8C are disposed facing an upper surface of the intermediate transfer medium 4 and the imaging unit 8Bk containing the black pressure-induced phase transition resin toner is solely disposed at a downstream side from the secondary transfer nip relative to the direction of conveyance of the recording medium P. In the color mode, only the imaging units 8Y, 8M, and 8C containing the thermoplastic resin toners of yellow, magenta, and cyan, respectively, are brought into operation. In the black-and-white mode, only the imaging unit 8Bk is brought into operation.

Referring to FIG. 11, the imaging unit 8Bk containing the black pressure-induced phase transition resin toner is disposed independently from the imaging units 8Y, 8M, and 8C containing the thermoplastic resin toners of yellow, magenta, and cyan, respectively. Example 1-4 illustrated in FIG. 11 is different from Example 1-3 illustrated in FIG. 10 in that the imaging unit 8K is omitted and only three imaging units 8Y, 8M, and 8C are tandemly arranged along an upper surface of the intermediate transfer medium 4.

Similar to Example 1-3, in the present embodiment using both the pressure-induced phase transition resin toner and the thermoplastic resin toner, the above-described advantage (F), i.e., improvement in cleanability of the pressure-induced phase transition resin toner, is provided as well as the advantages (A) to (E). The number of imaging units is smaller than Example 1-3. Similar to Example 1-3, the present embodiment has an advantage that switching between the black-and-white mode and the color mode is much easier. Namely, in the switching operation, the intermediate transfer medium 4 or the imaging unit 8Bk is moved away from or toward the recording medium conveying belt 7 rather than the photoreceptors 1Y, 1M, and 1C are moved away from or toward the intermediate transfer medium 4. Thus, the moving device gets much simpler than that in Examples 1-1 and 1-2. In the black-and-white mode, the intermediate transfer medium 4 is drawn away from the recording medium conveying belt 7, thus more improving the lifespan of the intermediate transfer medium 4 than in Examples 1-1 and 1-2. Similar to Examples 1-1 and 1-2, because the black pressure-induced phase transition resin toner is not likely to migrate to the intermediate transfer medium 4, the belt cleaner 25 does not need a cleaning brush for removing the black pressure-induced phase transition resin toner.

Example 1-5

Example 1-5 is different from Example 1-4 in that the imaging unit 8Bk containing the black pressure-induced phase transition resin toner is solely disposed at an upstream side from the secondary transfer nip relative to the direction of conveyance of the recording medium P. In the color mode, imaging units 8Y, 8M, and 8C containing the thermoplastic resin toners of yellow, magenta, and cyan, respectively, and the imaging unit 8Bk are brought into operation.

Referring to FIG. 12, the imaging unit 8Bk containing the black pressure-induced phase transition resin toner is disposed independently from the imaging units 8Y, 8M, and 8C containing the thermoplastic resin toners of yellow, magenta, and cyan, respectively. The imaging unit 8Bk is disposed facing an upper surface of the recording medium conveying belt 7 at an upstream side from the secondary transfer nip relative to the direction of conveyance of the recording medium P. Thus, the thermoplastic resin toners of yellow, magenta, and cyan transferred from the respective photoreceptors 1Y, 1M, and 1C onto the intermediate transfer medium 4 are prevented from being retransferred onto the photoreceptor 1Bk. In this embodiment, the photoreceptor 1Bk can be cleaned with great efficiency without separating the photoreceptor 1Bk from the recording medium conveying belt 7 in the color mode.

Similar to Examples 1-1 and 1-2, the belt cleaner 25 includes a cleaning brush on an upstream side and a cleaning blade on a down stream side relative to the direction of movement of the intermediate transfer medium 4. In the belt cleaner 25, the cleaning brush removes black pressure-induced phase transition resin toner particles retransferred onto the intermediate transfer medium 4 in the secondary transfer nip without applying mechanical stress thereto. The cleaning blade removes residual thermoplastic resin toner particles of yellow, magenta, and cyan remaining on the intermediate transfer medium 4. Thus, the intermediate transfer medium 4 can be cleaned with great efficiency. Owing to the effective cleaning of the intermediate transfer medium 4, the black pressure-induced phase transition resin toner is not retransferred onto the photoreceptors 1Y, 1M, and 1C. Therefore, each of the photoreceptors 1Y, 1M, and 1C can be cleaned with great efficiency with each of the respective photoreceptor cleaners 6Y, 6M, and 6C each including a cleaning blade and no cleaning brush.

In the black-and-white mode, similar to Examples 1-3 and 1-4, a black toner image is formed with the imaging unit 8Bk while the intermediate transfer medium 4 is drawn away from the recording medium conveying belt 7 by a moving device. In the color mode, a color toner image is formed with the imaging unit 8Bk and the imaging units 8Y, 8M, and 8C without separating the intermediate transfer medium 4 from the recording medium conveying belt 7. Namely, in the color mode, a color toner image is formed with all the imaging units while the intermediate transfer medium 4 is contacting the recording medium conveying belt 7.

Similar to Example 1-4, in the present embodiment using both the pressure-induced phase transition resin toner and the thermoplastic resin toner, the above-described advantage (F), i.e., improvement in cleanability of the pressure-induced phase transition resin toner, is provided as well as the advantages (A) to (E). The present embodiment has an advantage that switching between the black-and-white mode and the color mode is much easier. Namely, in the switching operation, the intermediate transfer medium 4 or the imaging unit 8Bk is moved away from or toward the recording medium conveying belt 7 rather than the photoreceptors 1Y, 1M, and 1C are moved away from or toward the intermediate transfer medium 4. Thus, the moving device gets much simpler than that in Examples 1-1 and 1-2. In the black-and-white mode, the intermediate transfer medium 4 is drawn away from the recording medium conveying belt 7, thus more improving the lifespan of the intermediate transfer medium 4 than in Examples 1-1 and 1-2. The number of imaging units is smaller than Example 1-3 and the later-described Example 1-6. Similar to Example 1-2, because the black pressure-induced phase transition resin toner is not likely to migrate to the photoreceptors 1Y, 1M, and 1C, each of the photoreceptor cleaners 6Y, 6M, and 6C does not need a cleaning brush for removing the black pressure-induced phase transition resin toner.

Example 1-6

Example 1-6 is different from Example 1-3 in that the thermoplastic resin toners of yellow, cyan, magenta, and black are directly transferred onto the recording medium P without using an intermediate transfer medium.

Referring to FIG. 13, the imaging units 8Y, 8C, 8M, and 8K containing the thermoplastic resin toners of yellow, cyan, magenta, and black, respectively, are disposed facing an upper surface of a recording medium conveying belt 10. The imaging units 8Y, 8C, 8M, and 8K are supported by a moving device. The moving device arbitrarily moves the imaging units 8Y, 8C, 8M, and 8K away from or toward the recording medium conveying belt 10. Primary transfer rollers 9Y, 9C, 9M, and 9K are disposed facing the photoreceptors 1Y, 1C, 1M, and 1K, respectively, with the recording medium conveying belt 10 therebetween. The primary transfer rollers 9Y, 9C, 9M, and 9K are adapted to transfer a toner image from the photoreceptors 1Y, 1C, 1M, and 1K, respectively, onto the recording medium P. Each of the primary transfer rollers 9Y, 9C, 9M, and 9K is supplied with a transfer bias when a toner image is directly transferred from each of the photoreceptors 1Y, 1C, 1M, and 1K onto the recording medium P conveyed by the recording medium conveying belt 10. The recording medium conveying belt 10 is stretched taut between the driven roller 22 and the driving roller 21 disposed at upstream and downstream sides, respectively, relative to the direction of conveyance of the recording medium P. The recording medium conveying belt 10 is rotatable clockwise in FIG. 13.

The belt cleaner 25 is disposed facing the driven roller 22 with the recording medium conveying belt 10 therebetween. The belt cleaner 25 is adapted to remove test patterns formed on the recording medium conveying belt 10 for adjusting image density and/or scattered toner particles. Toner particles to be removed by the belt cleaner 25 include the thermoplastic resin toners of yellow, cyan, magenta, and black only. Therefore, the belt cleaner 25 includes a cleaning blade but does not include a cleaning brush.

On a downstream side from the recording medium conveying belt 10 relative to the direction of conveyance of the recording medium P, the recording medium conveying belt 7, the heat fixing device 30, and the pressure fixing device 40 are disposed. Further, the imaging unit 8Bk containing the black pressure-induced phase transition resin toner is disposed facing an upper surface of the recording medium conveying belt 7. The recording medium conveying belt 10, the recording medium conveying belt 7, the heat fixing device 30, and the pressure fixing device 40 share the same height of recording medium conveying surface. In the black-and-white mode, only the black pressure-induced phase transition resin toner is used. In the color mode, the thermoplastic resin toners of yellow, magenta, cyan, and black are used.

In the black-and-white mode, a black toner image is formed with the imaging unit 8Bk while the imaging units 8Y, 8C, 8M, and 8K are drawn away from the recording medium conveying belt 10 by a moving device. Therefore, the thermoplastic resin toners of yellow, magenta, cyan, and black are prevented from being retransferred onto the photoreceptor 1Bk. Thus, in the same manner as Example 1-1, the photoreceptor cleaner 6Bk can clean the photoreceptor 1Bk with great efficiency. In the heat fixing device 30, the fixing roller 31 and the pressing roller 32 are separated from each other by a moving device.

In the black-and-white mode, unnecessary operations of the imaging units 8Y, 8M, 8C, and 8K and the intermediate transfer medium 4 are avoided so as to improve their lifespans.

In the color mode, a color toner image is formed on the recording medium P on the recording medium conveying belt 10 with the imaging units 8Y, 8M, 8C, and 8K while the photoreceptor 1Bk is drawn away from the recording medium conveying belt 7 by a moving device. Thus, the thermoplastic resin toners of yellow, magenta, cyan, and black are prevented from retransferred onto the photoreceptor 1Bk via the recording medium P and the photoreceptor 1Bk can be effectively cleaned.

Similar to Example 1-3, in the present embodiment using both the pressure-induced phase transition resin toner and the thermoplastic resin toner, the above-described advantage (F), i.e., improvement in cleanability of the pressure-induced phase transition resin toner, is provided as well as the advantages (A) to (E). Even though the number of imaging units is greater than Examples 1-1, 1-2, 1-4, and 1-5, similar to Example 1-2, the consumed amount of the thermoplastic resin toners is smaller than in Examples 1-1 and 1-4 in which a black toner image is formed with three thermoplastic resin toners of yellow, magenta, and cyan.

Example 2

Figure 14A:
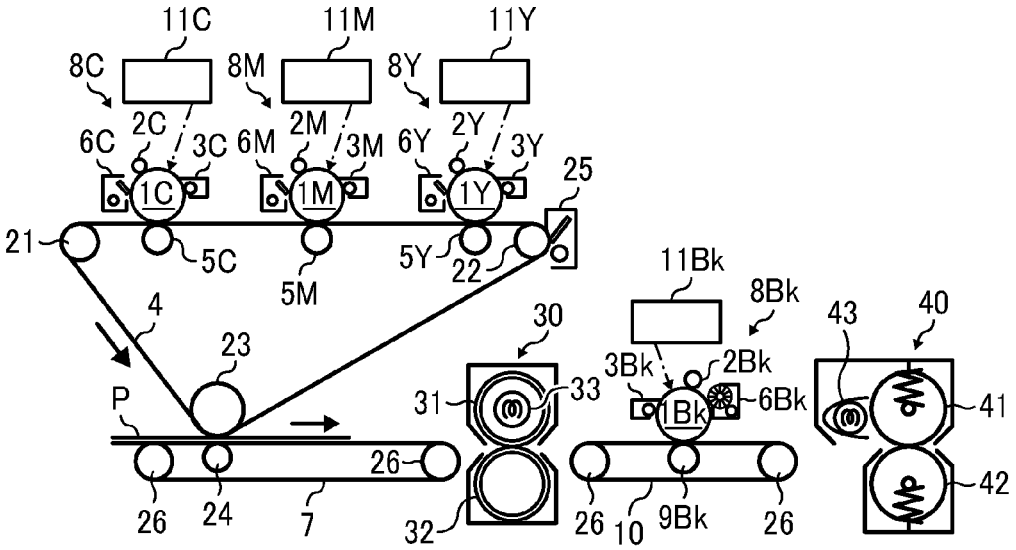
FIGS. 14A and 14B are schematic views of image forming apparatuses according to some embodiments.
Figure 14B:
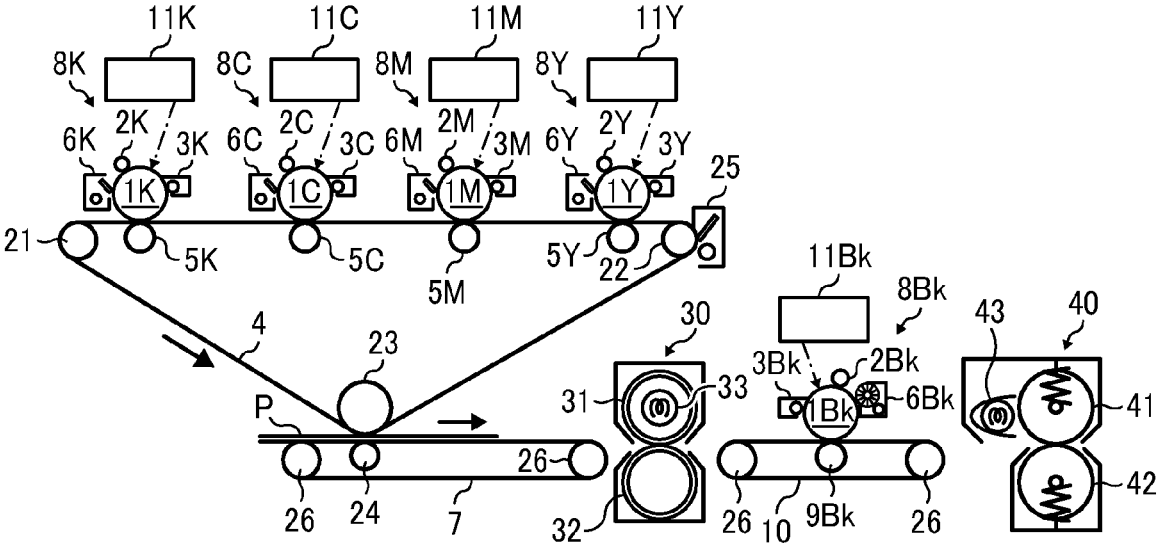

FIGS. 14A and 14B are schematic views of image forming apparatuses according to some embodiments (Examples 2-1 and 2-2, respectively). In Example 2-1 illustrated in FIG. 14A, three imaging units are arranged in tandem. In Example 2-2 illustrated in FIG. 14B, four imaging units are arranged in tandem. Example 2 is different from Example 1 in that the direct transfer nip in which the pressure-induced phase transition resin toner is directly transferred onto the recording medium P is disposed between the heat fixing nip in which the thermoplastic resin toner is fixed on the recording medium P and the pressure fixing nip in which the pressure-induced phase transition resin toner is fixed on the recording medium P.

Similar to Example 1, a black toner image is formed with the black pressure-induced phase transition resin toner and the pressure fixing nip is disposed at a downstream side from the heat fixing nip relative to the direction of conveyance of the recording medium P. Different from Example 1, the direct transfer nip in which the pressure-induced phase transition resin toner is transferred onto the recording medium P is disposed between the heat fixing nip and the pressure fixing nip. In particular, after the thermoplastic resin toner image is fixed on the recording medium P by heat, the black pressure-induced phase transition resin toner image is transferred onto the recording medium P and fixed thereon by pressure.

Referring to FIG. 14A, the imaging units 8Y, 8M, and 8C containing the thermoplastic resin toners of yellow, magenta, and cyan, respectively, are disposed facing an upper surface of the intermediate transfer medium 4. A secondary transfer device adapted to transfer a composite toner image formed on the intermediate transfer medium 4 onto the recording medium P conveyed by the recording medium conveying belt 7, and the heat fixing device 30 adapted to fix the composite toner image on the recording medium P by heat are also provided. On a downstream side from the heat fixing device 30 relative to the direction of conveyance of the recording medium P, the recording medium conveying belt 10 and the pressure fixing device 40 are disposed. Further, the imaging unit 8Bk containing the black pressure-induced phase transition resin toner is disposed facing an upper surface of the recording medium conveying belt 10.

In the black-and-white mode, a black toner image is formed with the imaging unit 8Bk only while the intermediate transfer medium 4 is drawn away from the recording medium conveying belt 7 by a moving device. Therefore, the thermoplastic resin toners of yellow, magenta, cyan, and black are prevented from being retransferred onto the photoreceptor 1Bk. Thus, in the same manner as Examples 1-3 and 1-4, the photoreceptor cleaner 6Bk can clean the photoreceptor 1Bk with great efficiency.

Because the direct transfer nip in which the black pressure-induced phase transition resin toner is transferred onto the recording medium P is disposed downstream from the heat fixing device 30 relative to the direction of conveyance of the recording medium P, it is not likely that the black pressure-induced phase transition resin toner migrates to the intermediate transfer medium 4. Therefore, the belt cleaner 25 does not need a cleaning brush.

In the black-and-white mode, unnecessary operations of the imaging units 8Y, 8M, and 8C and the intermediate transfer medium 4 are avoided so as to improve their lifespans.

In the color mode, a color toner image formed with the thermoplastic resin toners of yellow, magenta, and cyan on the intermediate transfer medium 4 is transferred onto the recording medium P conveyed by the recording medium conveying belt 7. The thermoplastic resin toner image is then fixed on the recording medium P by the heat fixing device 30. While the recording medium P having the fixed thermoplastic resin toner image thereon is conveyed by the recording medium conveying belt 10, the black pressure-induced phase transition resin toner image formed in the imaging unit 8Bk is directly transferred onto the recording medium P. The black pressure-induced phase transition resin toner image is then fixed thereon by the pressure fixing device 40. Thus, the thermoplastic resin toners of yellow, magenta, and cyan are prevented from retransferred onto the photoreceptor 1Bk via the recording medium P and the photoreceptor 1Bk can be effectively cleaned. In this embodiment, the photoreceptor 1Bk can be cleaned with great efficiency without separating the photoreceptor 1Bk in the color mode.

Therefore, in the same manner as the black-and-white mode, the belt cleaner 25 does not need a cleaning brush.

The imaging and fixing units for the black pressure-induced phase transition resin toner (i.e., the imaging unit 8Bk, the recording medium conveying belt 10, and the pressure fixing device 40) may be independent from the image forming apparatus. Namely, the full-color image forming apparatus including a hybrid imaging engine using the thermoplastic resin toners of yellow, magenta, and cyan and the black pressure-induced phase transition resin toner may be separated into another full-color image forming apparatus using the thermoplastic resin toners of yellow, magenta, and cyan only and a black-and-white image forming apparatus using the black pressure-induced phase transition resin toner only. In the full-color image forming apparatus including the imaging units 8Y, 8M, and 8C only, a black toner image is formed with the thermoplastic resin toners of yellow, magenta, and cyan either in the black-and-white mode and the color mode.

Similar to Example 1, in the present embodiment using both the pressure-induced phase transition resin toner and the thermoplastic resin toner, the above-described advantage (F), i.e., improvement in cleanability of the pressure-induced phase transition resin toner, is provided as well as the advantages (A) to (E). Similar to Examples 1-2 and 1-5, the above-described advantage (F), i.e., improvement in cleanability of the pressure-induced phase transition resin toner, is provided without separating the imaging unit 8Bk n the color mode. Similar to Examples 1-3 and 1-4, the belt cleaner 25 does not need a cleaning brush for removing the black pressure-induced phase transition resin toner.

The number of imaging units is three in Example 2-1 illustrated in FIG. 14A, but is not limited thereto. Referring to FIG. 14B illustrating Example 2-2, four imaging units 8Y, 8M, 8C, and 8K containing the thermoplastic resin toners of yellow, magenta, cyan, and black, respectively, are disposed facing an upper surface of the intermediate transfer medium 4. In Example 2-2, the imaging unit 8Bk is brought into operation only in the black-and-white mode.

Example 3

Figure 15A:
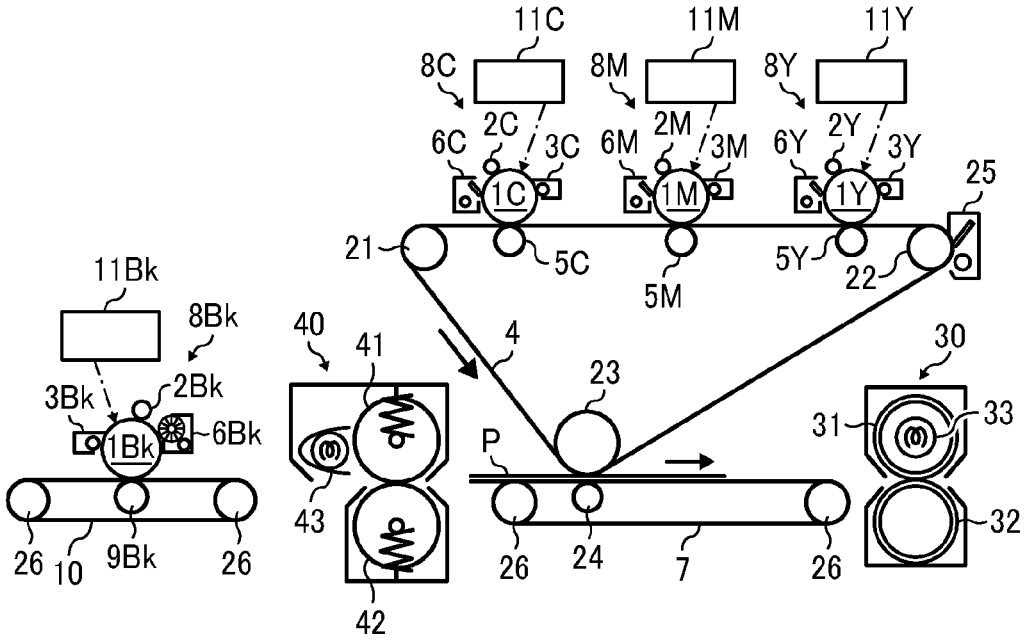
FIGS. 15A and 15B are schematic views of image forming apparatuses according to some embodiments.
Figure 15B:
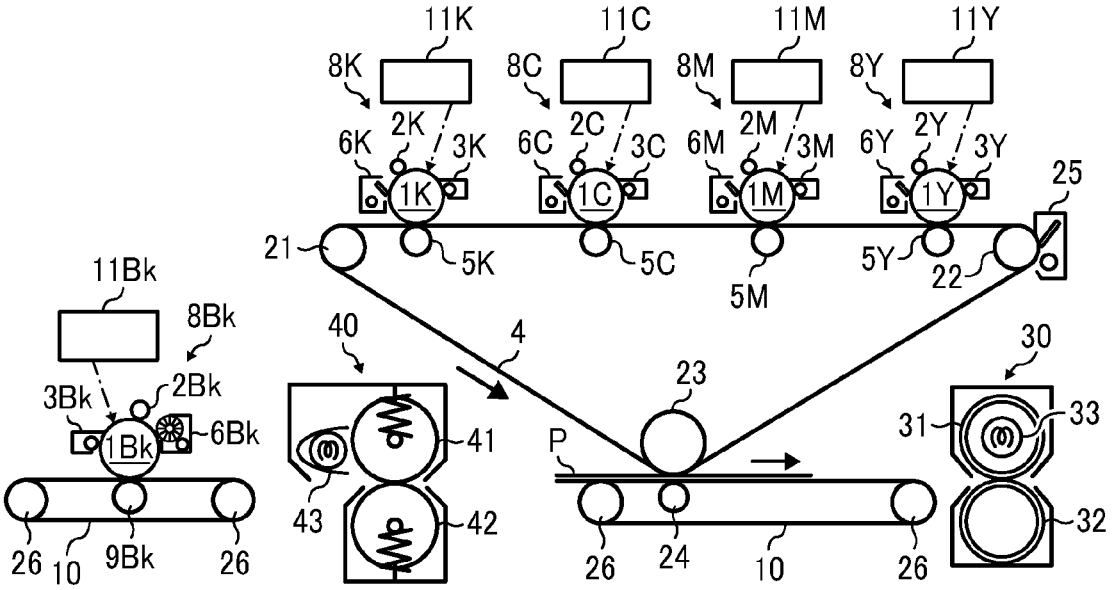

FIGS. 15A and 15B are schematic views of image forming apparatuses according to some embodiments (Examples 3-1 and 3-2, respectively). In Example 3-1 illustrated in FIG. 15A, three imaging units are arranged in tandem. In Example 3-2 illustrated in FIG. 15B, four imaging units are arranged in tandem. Example 3 is different from Example 2 in that the secondary transfer nip in which the thermoplastic resin toner is secondarily transferred onto the recording medium P is disposed between the heat fixing nip in which the thermoplastic resin toner is fixed on the recording medium P and the pressure fixing nip in which the pressure-induced phase transition resin toner is fixed on the recording medium P.

Similar to Example 2, a black toner image is formed with the black pressure-induced phase transition resin toner, the pressure fixing nip and the heat fixing nip are independent from each other, and the imaging unit 8Bk is independently provided. Different from Example 2, the secondary transfer nip in which the thermoplastic resin toner is secondarily transferred onto the recording medium P is disposed between the heat fixing nip and the pressure fixing nip. In particular, after the black pressure-induced phase transition resin toner is fixed on the recording medium P by pressure, the thermoplastic resin toner image is transferred onto the recording medium P and fixed thereon by heat.

Referring to FIG. 15A, on an upstream side from the imaging part relative to the direction of conveyance of the recording medium P, the recording medium conveying belt 10 and the pressure fixing device 40 are disposed. Further, the imaging unit 8Bk containing the black pressure-induced phase transition resin toner is disposed facing an upper surface of the recording medium conveying belt 10. The secondary transfer device adapted to transfer a composite toner image formed on the intermediate transfer medium 4 onto the recording medium P conveyed by the recording medium conveying belt 7 is disposed on a downstream side from the pressure fixing device 40 relative to the direction of conveyance of the recording medium P. The imaging units 8Y, 8M, and 8C containing the thermoplastic resin toners of yellow, magenta, and cyan, respectively, are disposed facing an upper surface of the intermediate transfer medium 4. The heat fixing device 30 is disposed on a downstream side from the secondary transfer device relative to the direction of conveyance of the recording medium P.

In the black-and-white mode, a black toner image is formed with the imaging unit 8Bk only while the intermediate transfer medium 4 is drawn away from the recording medium conveying belt 7 by a moving device. It is not likely that the black pressure-induced phase transition resin toner migrates to the intermediate transfer medium 4. Therefore, the belt cleaner 25 does not need a cleaning brush.

Because the direct transfer nip in which the black pressure-induced phase transition resin toner is transferred onto the recording medium P is disposed upstream from the secondary transfer device in which the thermoplastic resin toner is transferred onto the recording medium P relative to the direction of conveyance of the recording medium P, it is not likely that the thermoplastic resin toner is retransferred onto the photoreceptor 1Bk. Thus, in the same manner as Example 1-5, the photoreceptor cleaner 6Bk can clean the photoreceptor 1Bk with great efficiency.

In the black-and-white mode, unnecessary operations of the imaging units 8Y, 8M, and 8C and the intermediate transfer medium 4 are avoided so as to improve their lifespans.

In the color mode, while the recording medium P is conveyed by the recording medium conveying belt 10, the black pressure-induced phase transition resin toner image formed in the imaging unit 8Bk is directly transferred onto the recording medium P. The black pressure-induced phase transition resin toner image is then fixed thereon by the pressure fixing device 40. Thereafter, a color toner image formed with the thermoplastic resin toners of yellow, magenta, and cyan on the intermediate transfer medium 4 is transferred onto the recording medium P having the fixed black pressure-induced phase transition resin toner image thereon conveyed by the recording medium conveying belt 7. The thermoplastic resin toner image is then fixed on the recording medium P by the heat fixing device 30. Thus, the thermoplastic resin toners of yellow, magenta, and cyan are prevented from retransferred onto the photoreceptor 1Bk via the recording medium P and the photoreceptor 1Bk can be effectively cleaned.

It is not likely that the black pressure-induced phase transition resin toner is retransferred onto the intermediate transfer medium 4. In this embodiment, in the same manner as Example 2, the photoreceptor 1Bk can be cleaned with great efficiency without separating the photoreceptor 1Bk in the color mode.

Therefore, in the same manner as the black-and-white mode, the belt cleaner 25 does not need a cleaning brush.

Similar to Example 2, the imaging and fixing units for the black pressure-induced phase transition resin toner (i.e., the imaging unit 8Bk, the recording medium conveying belt 10, and the pressure fixing device 40) may be independent from the image forming apparatus.

In the color mode, the thermoplastic resin toner is secondarily transferred onto the recording medium P and fixed thereon by heat after the black pressure-induced phase transition resin toner is directly transferred onto the recording medium P and fixed thereon by pressure. Thus, in the color mode, the black pressure-induced phase transition resin toner fixed on the recording medium P by pressure is required not to be retransferred onto the fixing roller 31 when being heated in the heat fixing nip in the heat fixing device 30. Therefore, the thermoplastic resin toners of yellow, magenta, and cyan are required to be fixed on the recording medium P in the heat fixing nip in the heat fixing device 30 under pressure and temperature conditions in which the black pressure-induced phase transition resin toner does not cause hot offset. In a case in which the thermoplastic resin toners of yellow, magenta, and cyan are forced to be fixed on the recording medium P in the heat fixing nip in the heat fixing device 30 under pressure and temperature conditions in which the black pressure-induced phase transition resin toner does cause hot offset, a toner image may be formed only with the thermoplastic resin toners of yellow, magenta, and cyan without the black pressure-induced phase transition resin toner. In such a case, the photoreceptor 1Bk may be drawn away from the recording medium conveying belt 7 and the pressing rollers 41 and 42 may be separated from each other in the color mode so as to improve the lifespans of the imaging unit 8Bk and the pressure fixing device 40.

Similar to Example 2, in the present embodiment using both the pressure-induced phase transition resin toner and the thermoplastic resin toner, the above-described advantage (F), i.e., improvement in cleanability of the pressure-induced phase transition resin toner, is provided as well as the advantages (A) to (E). Similar to Examples 1-2 and 1-5, the above-described advantage (F), i.e., improvement in cleanability of the pressure-induced phase transition resin toner, is provided without separating the imaging unit 8Bk in the color mode. Similar to Examples 1-3 and 1-4, the belt cleaner 25 does not need a cleaning brush for removing the black pressure-induced phase transition resin toner. The imaging and fixing units for the black pressure-induced phase transition resin toner (i.e., the imaging unit 8Bk, the recording medium conveying belt 10, and the pressure fixing device 40) may be independent from the image forming apparatus. In the color mode, in a case in which the thermoplastic resin toners of yellow, magenta, and cyan are forced to be fixed on the recording medium P in the heat fixing nip in the heat fixing device 30 under pressure and temperature conditions in which the black pressure-induced phase transition resin toner does cause hot offset on the fixing roller 31, a color toner image may be formed only with the thermoplastic resin toners of yellow, magenta, and cyan without the black pressure-induced phase transition resin toner.

The number of imaging units is three in Example 3-1 illustrated in FIG. 15A, but is not limited thereto. Referring to FIG. 15B illustrating Example 3-2, four imaging units 8Y, 8M, 8C, and 8K containing the thermoplastic resin toners of yellow, magenta, cyan, and black, respectively, are disposed facing an upper surface of the intermediate transfer medium 4. In Example 3-2, the imaging unit 8Bk is brought into operation only in the black-and-white mode.

Example 4

Figure 16A:
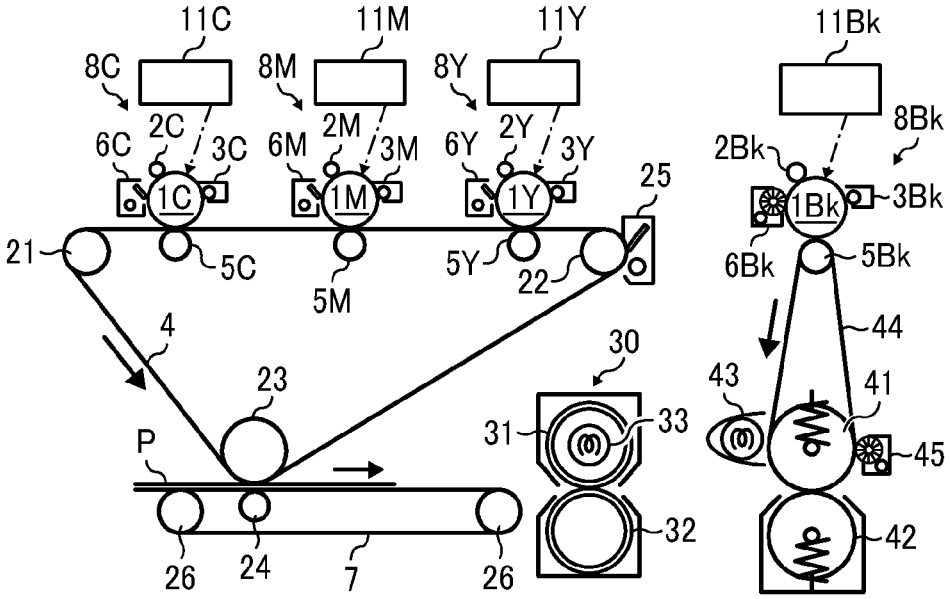
FIGS. 16A and 16B are schematic views of image forming apparatuses according to some embodiments.
Figure 16B:
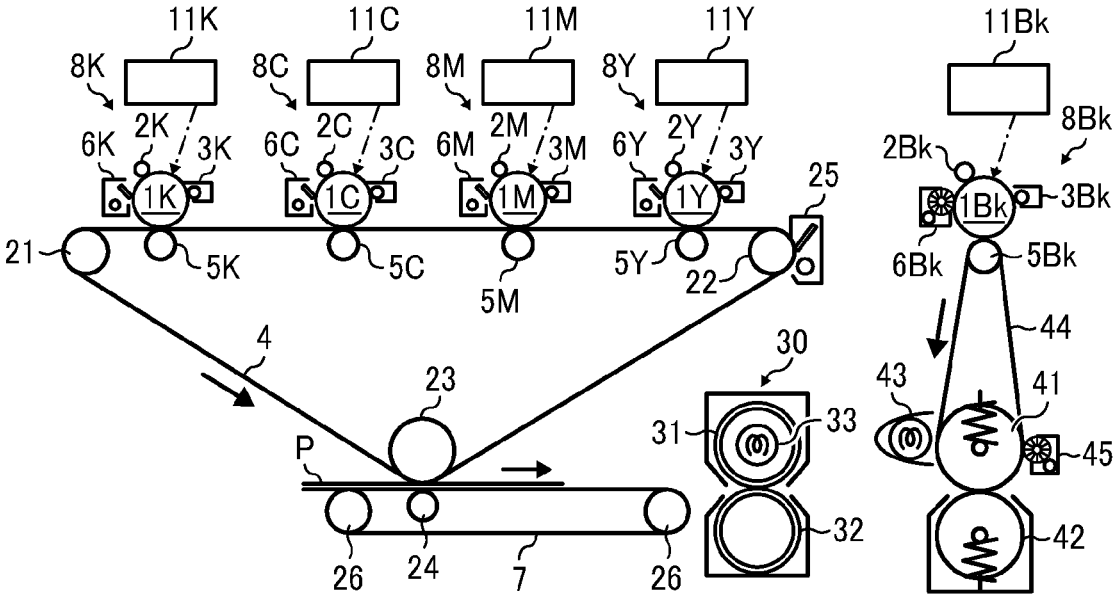

FIGS. 16A and 16B are schematic views of image forming apparatuses according to some embodiments (Examples 4-1 and 4-2, respectively). In Example 4-1 illustrated in FIG. 16A, three imaging units are arranged in tandem. In Example 4-2 illustrated in FIG. 16B, four imaging units are arranged in tandem. Example 4 is different from Example 2 in that the pressure-induced phase transition resin toner is simultaneously transferred onto and fixed on the recording medium P by pressure at a downstream side from the heat fixing nip in which the thermoplastic resin toner is fixed on the recording medium P by heat.

Referring to FIG. 16A, the photoreceptor 1Bk in the imaging unit 8Bk, the primary transfer roller 5Bk, and the pair of pressing rollers 41 and 42 are disposed on substantially the same vertical line in this order from the uppermost side. A transfer fixing belt 44 is stretched taut between the primary transfer roller 5Bk and the pressing roller 41. The transfer fixing belt 44 is disposed facing the photoreceptor 1Bk and the pressing roller 42, each being rotatable clockwise in FIG. 16A, thus forming a primary transfer nip and a transfer fixing nip, respectively. The transfer fixing belt 44 is rotatable counterclockwise in FIG. 16A. The halogen heater 43, serving as an auxiliary heat source, is disposed facing the transfer fixing belt 44 at substantially the same height of the rotation center of the pressing roller 41 and an upstream side of the pressing roller 41 relative to the direction of rotation thereof. A belt cleaner 45 for cleaning the transfer fixing belt 44 is disposed facing the transfer fixing belt 44 at a downstream side of the pressing roller 41 relative to the direction of rotation thereof.

A black pressure-induced phase transition resin toner image formed on the photoreceptor 1Bk is primarily transferred onto the transfer fixing belt 44 when the primary transfer roller 5Bk is supplied with a predetermined primary transfer bias. The black pressure-induced phase transition resin toner image is then conveyed to the position of the halogen heater 43 and heated to a predetermined temperature. The black pressure-induced phase transition resin toner image thus heated is conveyed to the transfer fixing nip defined between the pressing roller 42 and the transfer fixing belt 44 stretched by the pressing roller 41. The black pressure-induced phase transition resin toner image is simultaneously transferred onto and fixed on the recording medium P in the transfer fixing nip when the pressing rollers 41 and 42 apply a predetermined pressure thereto. The transfer fixing belt 44 may have a surface coating of a fluorine-containing polymer such as PFA and PTFE, for the purpose of improving releasability of the black pressure-induced phase transition resin toner therefrom. In the present embodiment, similar to Example 1, the heat fixing device 30 and the pressure fixing device 40 may be disposed adjacent to each other. In such a case, the halogen heater 43 may be omitted with cost reduction because the heat fixing device 30 can auxiliary heat the recording medium P with a low temperature and a low pressure.

The present embodiment provides the same effects as Example 2 both in the black-and-white mode and the color mode. In the present embodiment, the recording medium conveying belt 10, provided between the heat fixing device 30 and the pressure fixing device 40 or on a upstream side thereof relative to the direction of conveyance of the recording medium P in Examples 2 and 3, are omitted, which contributes to the reduction in size of the image forming apparatus. Namely, the recording medium conveying belt 10, a pair of tension rollers 26, and the primary transfer roller 5Bk can be omitted with cost reduction. Additionally, the halogen heater 43 may be omitted with cost reduction because the heat fixing device 30 can auxiliary heat the recording medium P with a low temperature and a low pressure.

The number of imaging units is three in Example 4-1 illustrated in FIG. 16A, but is not limited thereto. Referring to FIG. 16B illustrating Example 4-2, four imaging units 8Y, 8M, 8C, and 8K containing the thermoplastic resin toners of yellow, magenta, cyan, and black, respectively, are disposed facing an upper surface of the intermediate transfer medium 4. In Example 4-2, the imaging unit 8Bk is brought into operation only in the black-and-white mode.

Example 5

Figure 17A:
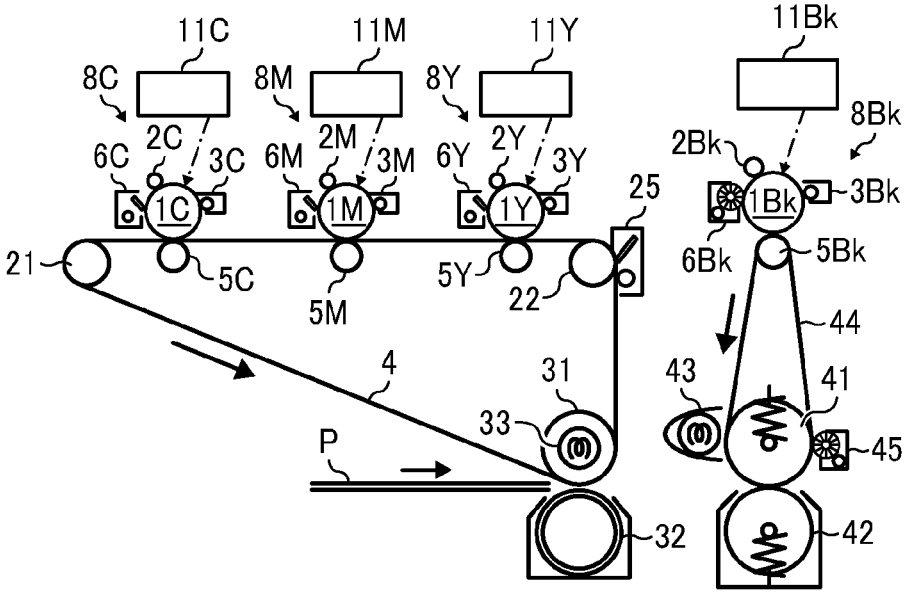
FIGS. 17A and 17B are schematic views of image forming apparatuses according to some embodiments.
Figure 17B:
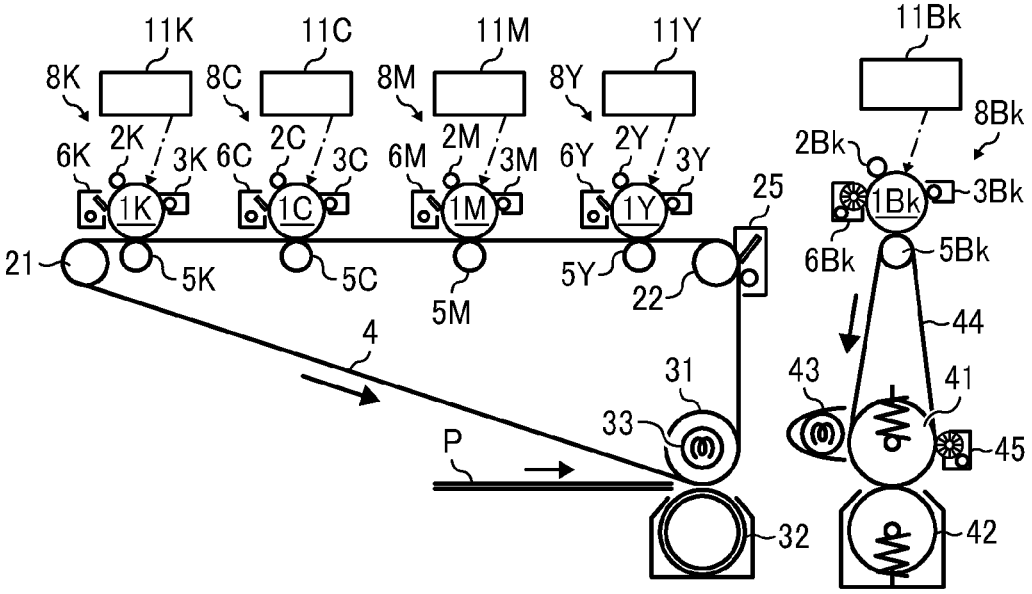

FIGS. 17A and 17B are schematic views of image forming apparatuses according to some embodiments (Examples 5-1 and 5-2, respectively). In Example 5-1 illustrated in FIG. 17A, three imaging units are arranged in tandem. In Example 5-2 illustrated in FIG. 17B, four imaging units are arranged in tandem. Example 5 is different from Example 4 in that the thermoplastic resin toner is also simultaneously transferred onto and fixed on the recording medium P.

Referring to FIG. 17A, the intermediate transfer medium 4 is stretched across the driven roller 22, the driving roller 21, and the fixing roller 31. The fixing roller 31 is disposed so that the part of the intermediate transfer medium 4 stretched between the fixing roller 31 and the driven roller 22 gets substantially vertical.

Toner images formed on the photoreceptors 1Y, 1M, and 1C are sequentially and primarily transferred onto the intermediate transfer medium 4 to form a composite toner image thereon when the primary transfer rollers 5Y, 5M, and 5C are supplied with a predetermined primary transfer bias, respectively. The composite toner image is then conveyed to the position where the intermediate transfer medium 4 is facing the pressing roller 32 as the driving roller 21 rotates the intermediate transfer medium 4. The composite toner image is simultaneously transferred onto and fixed on the recording medium P in the transfer fixing nip when the fixing roller 31 and the pressing roller 32 apply a predetermined pressure thereto. In the present embodiment, the secondary facing roller 23 provided in Example 4 can be omitted with cost reduction.

The present embodiment provides the same effects as Example 4 both in the black-and-white mode and the color mode. Additionally, the secondary facing roller 23 provided in Example 4 can be omitted with cost reduction.

The number of imaging units is three in Example 5-1 illustrated in FIG. 17A, but is not limited thereto. Referring to FIG. 17B illustrating Example 5-2, four imaging units 8Y, 8M, 8C, and 8K containing the thermoplastic resin toners of yellow, magenta, cyan, and black, respectively, are disposed facing an upper surface of the intermediate transfer medium 4. In Example 5-2, the imaging unit 8Bk is brought into operation only in the black-and-white mode.

Example 6

Figure 18A:
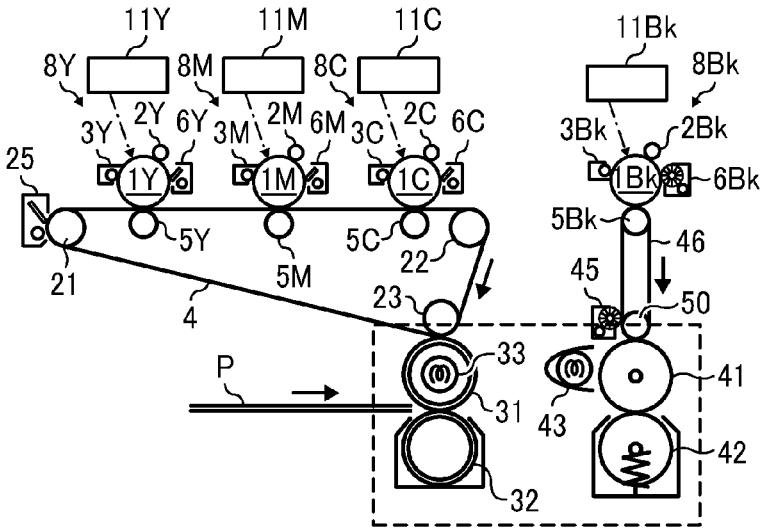
FIGS. 18A to 18C are schematic views of image forming apparatuses according to some embodiments.
Figure 18B:
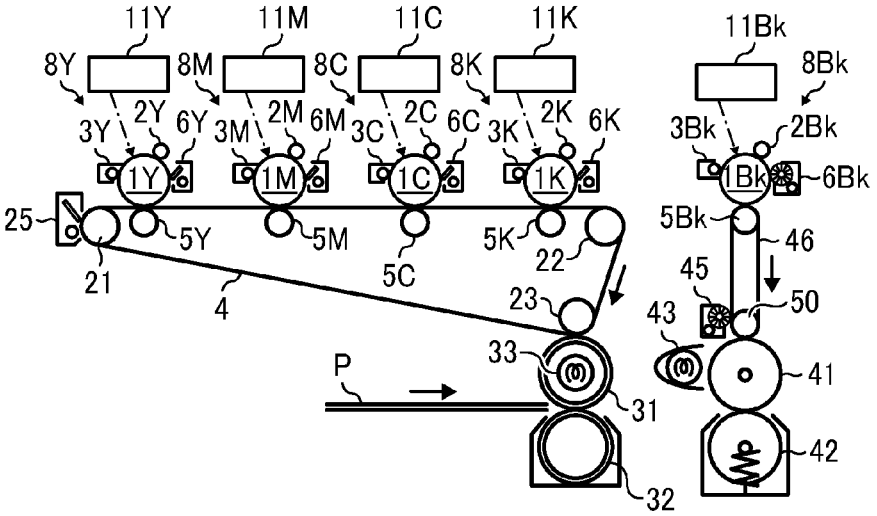
Figure 18C:
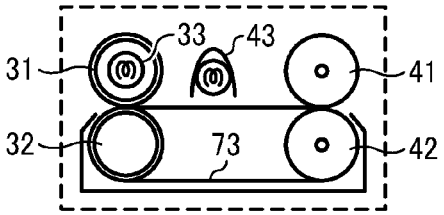

FIGS. 18A and 18B are schematic views of image forming apparatuses according to some embodiments (Examples 6-1 and 6-2, respectively). In Example 6-1 illustrated in FIG. 18A, three imaging units are arranged in tandem. In Example 6-2 illustrated in FIG. 18B, four imaging units are arranged in tandem. FIG. 18C is a schematic view of a fixing device according to an embodiment (Example 6-3). Example 6 is different from Example 5 in that the thermoplastic resin toner and the pressure-induced phase transition resin toner are primarily transferred from the respective photoreceptors onto the intermediate transfer media 4 and 46, respectively, and secondarily transferred onto the respective fixing members, i.e., the fixing roller 31 and pressing roller 41, respectively. Thereafter, the toner images are simultaneously transferred onto and fixed on the recording medium P in the respective transfer fixing nips.

Similar to Example 5, either a toner image formed with the thermoplastic resin toners of yellow, magenta, and cyan or a toner image formed with the black pressure-induced phase transition resin toner is simultaneously transferred onto and fixed on the recording medium P. However, different from Example 5, the toner image formed with the thermoplastic resin toners on the intermediate transfer medium 4 is secondarily transferred onto the fixing roller 31 first and then simultaneously transferred onto and fixed on the recording medium P. Similarly, the toner image formed with the black pressure-induced phase transition resin toner on an intermediate transfer medium 46 is secondarily transferred onto the pressing roller 41 first and then simultaneously transferred onto and fixed on the recording medium P.

Thermoplastic resin toner images formed on the photoreceptors 1Y, 1M, and 1C are sequentially and primarily transferred onto the intermediate transfer medium 4 to form a composite toner image thereon when the primary transfer rollers 5Y, 5M, and 5C are supplied with a predetermined primary transfer bias, respectively. The composite toner image is then conveyed to the secondary transfer nip where the intermediate transfer medium 4 is facing the fixing roller 31 as the driving roller 21 rotates the intermediate transfer medium 4. The composite toner image is transferred onto the fixing roller 31 in the secondary transfer nip when the secondary transfer facing roller 23 is supplied with a secondary transfer bias (which may be overlapped with an AC or a pulse). The composite toner image is then conveyed to the transfer fixing nip defined between the fixing roller 31 and the pressing roller 32 as the fixing roller 31 rotates while being heated by the halogen heater 33. The composite toner image is simultaneously transferred onto and fixed on the recording medium P in the transfer fixing nip when the fixing roller 31 and the pressing roller 32 apply predetermined heat and pressure thereto.

A black pressure-induced phase transition resin toner image formed on the photoreceptor 1Bk is primarily transferred onto the intermediate transfer medium 46 when the primary transfer roller 5Bk is supplied with a predetermined primary transfer bias. The black pressure-induced phase transition resin toner image is then conveyed to the secondary transfer nip where the intermediate transfer medium 46 is facing the pressing roller 41 as a secondary transfer roller 50 rotates the intermediate transfer medium 46. The black pressure-induced phase transition resin toner image is transferred onto the fixing roller 41 in the secondary transfer nip when the secondary transfer roller 50 is supplied with a secondary transfer bias (which may be overlapped with an AC or a pulse). The black pressure-induced phase transition resin toner image is then conveyed to the transfer fixing nip defined between the pressing roller 41 and the pressing roller 42 as the pressing roller 41 rotates while being heated by the halogen heater 43. The black pressure-induced phase transition resin toner image is simultaneously transferred onto and fixed on the recording medium P in the transfer fixing nip when the pressing roller 41 and the pressing roller 42 apply a predetermined pressure thereto.

In a case in which the black pressure-induced phase transition resin toner image is electrostatically transferred from the intermediate transfer medium 46 onto the pressing roller 41 which is metallic, the pressing roller 41 may have a thin surface coating including a proper amount of carbon or an ionic resistivity controlling agent to have a middle-level surface resistivity of $10^5$ to $10^{12}$ Ω·cm.

The number of imaging units is three in Example 6-1 illustrated in FIG. 18A, but is not limited thereto. Referring to FIG. 18B illustrating Example 6-2, four imaging units 8Y, 8M, 8C, and 8K containing the thermoplastic resin toners of yellow, magenta, cyan, and black, respectively, are disposed facing an upper surface of the intermediate transfer medium 4. In Example 6-2, the imaging unit 8Bk is brought into operation only in the black-and-white mode.

In the field of engineering plastics or bio plastics, resin materials having a micro phase separation structure have been developed and studied to be moldable with pressure at low temperatures. Also, there are attempts to use these materials in electrophotography. In a block copolymer or resin in which two or more different kinds of polymers are covalently bonded to each other, each polymer chain independently aggregates and forms each micro phase separation structure. It is widely known that such a block copolymer or resin transits between a sea-island structure, a cylindrical structure, and a lamella structure according to the composition of polymers consisting it. A technical document entitled "The Effect of Hydrostatic Pressure on the Lower Critical Ordering Transition in Diblock Copolymers" (Pollard, M. et al., Macromolecules, 31, 6493-6498 (1998)) studies the structures of such block copolymers and resins with micronucleus neutron scattering and describes that such block copolymers and resins exhibit fluidity under pressure stimuli.

A technical document entitled "A simple model for baroplastic behavior in block copolymer melts" (Ruzette, A.-V. G. et al., Journal of Chemical Physics, 114, 8205-8209 (2001)) describes that nano-sized core-shell resin particles, as well as block copolymers, exhibit fluidity under pressure stimuli. This document theoretically and experimentally proves based on the Flory-Huggins solution theory that each of the polymers consisting such a resin exhibiting fluidity under pressure stimuli transit from an ordered state to a disordered state based on mass density, solubility parameter, and expansion coefficient thereof under the pressure stimuli. Such resins are named as "baroplastics" in the document.

It is proven that the resins described in the document entitled "The Effect of Hydrostatic Pressure on the Lower Critical Ordering Transition in Diblock Copolymers" cause phase transition under pressure stimuli and thus exhibit fluidity. A technical document entitled "Low-temperature processing of 'baroplastics' by pressure-induced flow" (Gonzalez-Leon, J. A. et al., Nature, 426, 424-428 (2003)) describes that pressure-induced phase transition easily occurs in a resin having a micro phase separation structure having a soft polymer segment (having a low glass transition temperature or melting point of −30° C. or less) and a hard polymer segment (having a high glass transition temperature of 50° C. or more).

Various copolymers and resins having a micro phase separation structure, including those having a soft segment and a hard segment, have been proposed manufactured by various methods since before the fluidization phenomenon of such resins is recognized. For example, ethylene-based unsaturated compounds prepared by mini emulsion processes or living radial polymerizations and polyester block copolymers including amorphous blocks and crystalline blocks are well known. The latter is described in, for example, "Biopolymers, Polyester II—Properties and Chemical Synthesis" (Doi, Y. et al., Wiley-VCH (2002)).

Additional modifications and variations in accordance with further embodiments of the present invention are possible in light of the above teachings. It is therefore to be understood that within the scope of the appended claims the invention may be practiced other than as specifically described herein.

What is claimed is:

1. An image forming apparatus, comprising:

multiple imaging units, each imaging unit including:

an image bearing member;

a developing device containing a toner, the developing device being adapted to develop an electrostatic latent image formed on the image bearing member into a toner image with the toner, the toner including a pressure-induced phase transition resin or a thermoplastic resin;

a transfer device adapted to transfer the toner image from the image bearing member onto an intermediate transfer medium or a recording medium; and an image bearing member cleaner adapted to remove residual toner particles remaining on the image bearing member without being transferred; and a fixing unit adapted to fix the toner images on the recording medium, the fixing unit including:

a pressure fixing device adapted to fix the toner including the pressure-induced phase transition resin on the recording medium by applying a temperature Tb and a pressure Pb thereto in a pressure fixing nip; and a heat fixing device adapted to fix the toner including the thermoplastic resin on the recording medium by applying a temperature Ta and a pressure Pa thereto in a heat fixing nip, wherein the following inequalities are satisfied:

$Tb<Ta$ and $Pb>Pa$, wherein the toner including the pressure-induced phase transition resin is contained in at least one of the developing devices and the toner including the thermoplastic resin is contained in at least one of the developing devices, and wherein the heat fixing device is switchable between a state in which the heat fixing nip is formed and a state in which the fixing nip is not formed, and the pressure fixing device is switchable between a state in which the pressure fixing nip is formed and a state in which the pressure fixing nip is not formed.

2. The image forming apparatus according to claim 1, wherein at least one of the toners including the pressure-induced phase transition resin further includes a black colorant.

3. An image forming apparatus, comprising:

multiple imaging units, each imaging unit including:

an image bearing member;

a developing device containing a toner, the developing device being adapted to develop an electrostatic latent image formed on the image bearing member into a toner image with the toner, the toner including a pressure-induced phase transition resin or a thermoplastic resin;

a transfer device adapted to transfer the toner image from the image bearing member onto an intermediate transfer medium or a recording medium; and an image bearing member cleaner adapted to remove residual toner particles remaining on the image bearing member without being transferred; and a primary transfer device adapted to transfer the toner image including the toner including the thermoplastic resin on an intermediate transfer medium;

a secondary transfer device adapted to transfer the toner image including the toner including the thermoplastic resin from the intermediate transfer medium onto a recording medium;

a direct transfer device adapted to transfer the toner image including the toner including the pressure-induced phase transition resin on the recording medium;

a fixing unit adapted to fix the toner images on the recording medium, the fixing unit including:

a pressure fixing device adapted to fix the toner including the pressure-induced phase transition resin on the recording medium by applying a temperature Tb and a pressure Pb thereto in a pressure fixing nip; and a heat fixing device adapted to fix the toner including the thermoplastic resin on the recording medium by applying a temperature Ta and a pressure Pa thereto in a heat fixing nip, wherein the following inequalities are satisfied:

Tb<Ta and Pb>Pa, wherein the toner including the pressure-induced phase transition resin is contained in at least one of the developing devices and the toner including the thermoplastic resin is contained in at least one of the developing devices.

4. The image forming apparatus according to claim 1, wherein at least one of the pressure fixing device or the heat fixing device is adapted to simultaneously transfer the toner image onto the recording medium and fix the toner image on the recording medium.

5. The image forming apparatus according to claim 1, wherein the recording medium is adapted to pass the heat fixing device first and the pressure fixing device thereafter.

6. The image forming apparatus according to claim 3, wherein the direct transfer device is disposed between the heat fixing device and the pressure fixing device.

7. The image forming apparatus according to claim 3, wherein the secondary transfer device is disposed between the heat fixing device and the pressure fixing device.

8. The image forming apparatus according to claim 1, wherein the imaging unit containing the toner including the pressure-induced phase transition resin and the pressure fixing device are integrally detachable from the image forming apparatus.

9. An image forming apparatus, comprising:

multiple means for imaging, each means for imaging including:

means for bearing an electrostatic latent image;

means for developing the electrostatic latent image into a toner image with a toner, the toner including a pressure-induced phase transition resin or a thermoplastic resin;

means for transferring the toner image from the means for bearing onto an intermediate transfer medium or a recording medium; and means for removing residual toner particles remaining on the means for bearing without being transferred; and means for fixing the toner images on the recording medium, the means for fixing including:

means for fixing the toner including the pressure-induced phase transition resin on the recording medium by applying a temperature Tb and a pressure Pb thereto; and means for fixing the toner including the thermoplastic resin on the recording medium by applying a temperature Ta and a pressure Pa thereto, wherein the following inequalities are satisfied:

Tb<Ta and Pb>Pa, wherein the toner including the pressure-induced phase transition resin is contained in at least one of the means for developing and the toner including the thermoplastic resin is contained in at least one of the means for developing, and wherein the means for fixing the toner is switchable between a state in which a heat fixing nip is formed and a state in which a heat fixing nip is not formed, and the means for fixing the toner is switchable between a state in which a pressure fixing nip is formed and a state in which a pressure fixing nip is not formed.

* * * * *